US010597814B2

(12) United States Patent
Wells et al.

(10) Patent No.: US 10,597,814 B2
(45) Date of Patent: Mar. 24, 2020

(54) DRYING APPARATUS AND METHOD

(71) Applicant: Xeros Limited, Rotherham (GB)

(72) Inventors: Simon Paul Wells, Rotherham (GB); Michael David Sawford, Rotherham (GB); Gareth Evan Lyn Jones, Bath (GB)

(73) Assignee: Xeros Limited, Rotherham, South Yorkshire (GB)

( * ) Notice: Subject to any disclaimer, the term of this patent is extended or adjusted under 35 U.S.C. 154(b) by 174 days.

(21) Appl. No.: 15/863,062

(22) Filed: Jan. 5, 2018

(65) Prior Publication Data

US 2018/0127914 A1 May 10, 2018

Related U.S. Application Data

(63) Continuation of application No. 14/777,568, filed as application No. PCT/GB2014/050855 on Mar. 18, 2014, now Pat. No. 10,017,895.

(30) Foreign Application Priority Data

Mar. 20, 2013 (GB) ..... 1305121.4

(51) Int. Cl.
*D06F 58/00* (2020.01)
*D06F 58/02* (2006.01)
(Continued)

(52) U.S. Cl.
CPC ..... *D06F 58/02* (2013.01); *D06F 35/00* (2013.01); *F26B 5/00* (2013.01)

(58) Field of Classification Search
CPC ..... D06F 58/02; D06F 35/00; D06F 35/005; D06F 58/203; F26B 5/00
(Continued)

(56) References Cited

U.S. PATENT DOCUMENTS 5,498,115 A * 3/1996 Perneborn ..... B05C 19/04 198/671
8,959,961 B2 2/2015 Jenkins et al.
(Continued)

FOREIGN PATENT DOCUMENTS

CN 102061588 A 5/2011
CN 102061589 A 5/2011
(Continued)

OTHER PUBLICATIONS

U.S. Appl. No. 15/578,306, Sawford et al.
(Continued)

*Primary Examiner* — John P McCormack
(74) *Attorney, Agent, or Firm* — Clark & Elbing LLP

(57) ABSTRACT

The invention provides an apparatus and method for use in the drying of substrates using a solid particulate material, the apparatus comprising:

(a) housing means having mounted therein a rotatably mounted cylindrical drum;
(b) access means; and
(c) at least one collection means, wherein the rotatably mounted cylindrical drum additionally comprises capturing and transferring means, adapted to facilitate collection of the solid particulate material and transfer of the material to the at least one collection means. The invention also provides a method for drying a wet substrate, the method comprising treating the substrate with a solid particulate material at ambient or elevated temperature, the treatment being carried out using the apparatus of the invention. The apparatus and method find particular application in the drying of wet textile fabrics.

30 Claims, 10 Drawing Sheets

(51) Int. Cl.
*D06F 35/00* (2006.01)
*F26B 5/00* (2006.01)

(58) Field of Classification Search
USPC .... 68/23.6; 34/297, 109, 108, 112, 397, 602
See application file for complete search history.

(56) References Cited

U.S. PATENT DOCUMENTS

| | | | |
|---|---|---|---|
| 8,974,545 | B2 | 3/2015 | Burkinshaw et al. |
| 9,017,423 | B2 | 4/2015 | Burkinshaw et al. |
| 9,121,000 | B2 | 9/2015 | Burkinshaw et al. |
| 9,127,882 | B2 | 9/2015 | Jenkins et al. |
| 9,297,107 | B2 | 3/2016 | Jenkins |
| 9,315,766 | B2 | 4/2016 | He et al. |
| 9,404,210 | B2 | 8/2016 | He et al. |
| 9,410,278 | B2 | 8/2016 | He et al. |
| 9,476,155 | B2 | 10/2016 | He et al. |
| 9,487,898 | B2 | 11/2016 | He et al. |
| 9,523,169 | B2 | 12/2016 | Sawford et al. |
| 9,550,966 | B2 | 1/2017 | Burkinshaw et al. |
| 9,587,337 | B2 | 3/2017 | He et al. |
| 9,587,340 | B2 | 3/2017 | Jenkins et al. |
| 9,631,314 | B2 | 4/2017 | Yin et al. |
| 9,803,307 | B2 | 10/2017 | Jenkins et al. |
| 9,834,881 | B2 | 12/2017 | Sawford et al. |
| 9,845,516 | B2 | 12/2017 | Steele |
| 9,850,455 | B2 | 12/2017 | Jenkins et al. |
| 9,850,619 | B2 | 12/2017 | Wells et al. |
| 9,914,901 | B2 | 3/2018 | Burkinshaw et al. |
| 9,932,700 | B2 | 4/2018 | Wells et al. |
| 10,017,895 | B2 | 7/2018 | Wells et al. |
| 10,081,900 | B2 | 9/2018 | Wells et al. |
| 10,287,642 | B2 | 5/2019 | Scott |
| 10,301,691 | B2 | 5/2019 | Feyisa et al. |
| 10,316,448 | B2 | 6/2019 | He et al. |
| 2008/0202435 | A1 | 8/2008 | Nowacek |
| 2009/0276966 | A1 | 11/2009 | Mette et al. |
| 2011/0296628 | A1* | 12/2011 | Jenkins ..... D06F 35/00 8/137 |
| 2012/0048299 | A1 | 3/2012 | Jenkins et al. |
| 2012/0284931 | A1 | 11/2012 | Jenkins et al. |
| 2012/0304400 | A1 | 12/2012 | Jenkins et al. |
| 2013/0061404 | A1 | 3/2013 | Jenkins |
| 2013/0167882 | A1 | 7/2013 | Burkinshaw et al. |
| 2013/0276242 | A1 | 10/2013 | Jenkins et al. |
| 2013/0283542 | A1 | 10/2013 | Jenkins et al. |
| 2014/0201929 | A1 | 7/2014 | He et al. |
| 2014/0317860 | A1 | 10/2014 | He et al. |
| 2015/0027173 | A1 | 1/2015 | Wu et al. |
| 2015/0096128 | A1 | 4/2015 | Sawford et al. |
| 2015/0096129 | A1 | 4/2015 | Sawford et al. |
| 2015/0128358 | A1 | 5/2015 | Wells et al. |
| 2015/0148278 | A1 | 5/2015 | Burkinshaw et al. |
| 2015/0152357 | A1 | 6/2015 | Abercrombie et al. |
| 2015/0152585 | A1 | 6/2015 | Sawford et al. |
| 2015/0175945 | A1 | 6/2015 | Waddon et al. |
| 2015/0252511 | A1 | 9/2015 | Roberts et al. |
| 2015/0344824 | A1 | 12/2015 | Burkinshaw et al. |
| 2016/0032522 | A1 | 2/2016 | Steele |
| 2016/0040260 | A1 | 2/2016 | Steele |
| 2016/0122932 | A1 | 5/2016 | Wells et al. |
| 2016/0195409 | A1 | 7/2016 | Goldberg et al. |
| 2016/0197998 | A1 | 7/2016 | Carleo |
| 2016/0251602 | A1 | 9/2016 | Steele et al. |
| 2016/0251603 | A1 | 9/2016 | Steele et al. |
| 2016/0251795 | A1 | 9/2016 | Wells et al. |
| 2017/0051447 | A1 | 2/2017 | He et al. |
| 2017/0137983 | A1 | 5/2017 | He et al. |
| 2017/0159222 | A1 | 6/2017 | Jenkins et al. |
| 2017/0240980 | A1 | 8/2017 | Feyisa et al. |
| 2017/0240981 | A1 | 8/2017 | Scott |
| 2017/0240982 | A1 | 8/2017 | Sadeghi |
| 2017/0241061 | A1 | 8/2017 | Wells et al. |
| 2017/0247771 | A1 | 8/2017 | Scott |
| 2017/0267949 | A1 | 9/2017 | Bird et al. |
| 2018/0057777 | A1 | 3/2018 | Waddon et al. |
| 2018/0134994 | A1 | 5/2018 | Steele et al. |
| 2018/0141089 | A1 | 5/2018 | Sawford et al. |
| 2018/0216049 | A1 | 8/2018 | Bird et al. |
| 2019/0144959 | A1 | 5/2019 | Ashfaq et al. |
| 2019/0210892 | A1 | 7/2019 | Scott et al. |
| 2019/0211288 | A1 | 7/2019 | Potts et al. |
| 2019/0233760 | A1 | 8/2019 | Lavery et al. |

FOREIGN PATENT DOCUMENTS

| | | | |
|---|---|---|---|
| CN | 202175862 | U | 3/2012 |
| CN | 102425053 | A | 4/2012 |
| CN | 102425055 | A | 4/2012 |
| CN | 202214631 | U | 5/2012 |
| CN | 202214633 | U | 5/2012 |
| CN | 202298219 | U | 7/2012 |
| CN | 202298220 | U | 7/2012 |
| CN | 202298222 | U | 7/2012 |
| CN | 202323458 | U | 7/2012 |
| CN | 202359387 | U | 8/2012 |
| CN | 202359388 | U | 8/2012 |
| CN | 202359389 | U | 8/2012 |
| CN | 202359390 | U | 8/2012 |
| CN | 202359396 | U | 8/2012 |
| CN | 202401272 | U | 8/2012 |
| CN | 202492706 | U | 10/2012 |
| CN | 202543632 | U | 11/2012 |
| CN | 202543634 | U | 11/2012 |
| CN | 202543635 | U | 11/2012 |
| CN | 202543646 | U | 11/2012 |
| CN | 202543652 | U | 11/2012 |
| CN | 102899848 | A | 1/2013 |
| CN | 202688698 | U | 1/2013 |
| CN | 202755220 | U | 2/2013 |
| CN | 202755221 | U | 2/2013 |
| CN | 102953249 | A | 3/2013 |
| CN | 102953250 | A | 3/2013 |
| CN | 102953262 | A | 3/2013 |
| CN | 102978870 | A | 3/2013 |
| CN | 103061084 | A | 4/2013 |
| CN | 103061085 | A | 4/2013 |
| CN | 103061086 | A | 4/2013 |
| CN | 103061087 | A | 4/2013 |
| CN | 103087839 | A | 5/2013 |
| CN | 103103720 | A | 5/2013 |
| CN | 103103721 | A | 5/2013 |
| CN | 103122566 | A | 5/2013 |
| CN | 103122567 | A | 5/2013 |
| CN | 202913242 | U | 5/2013 |
| CN | 103225192 | A | 7/2013 |
| CN | 203049283 | U | 7/2013 |
| CN | 103361934 | A | 10/2013 |
| CN | 103361938 | A | 10/2013 |
| CN | 203370359 | U | 1/2014 |
| CN | 102061588 | B | 2/2014 |
| CN | 103556439 | A | 2/2014 |
| CN | 203530695 | U | 4/2014 |
| CN | 203530700 | U | 4/2014 |
| CN | 203530714 | U | 4/2014 |
| CN | 203530718 | U | 4/2014 |
| CN | 203530723 | U | 4/2014 |
| CN | 203530725 | U | 4/2014 |
| CN | 103285643 | B | 4/2015 |
| CN | 103451894 | B | 11/2015 |
| CN | 103556434 | B | 11/2015 |
| CN | 103556436 | B | 11/2015 |
| CN | 103556431 | B | 1/2016 |
| CN | 103556432 | B | 3/2016 |
| CN | 105420992 | A | 3/2016 |
| CN | 105420993 | A | 3/2016 |
| CN | 105421000 | A | 3/2016 |
| CN | 105442267 | A | 3/2016 |
| CN | 205329373 | U | 6/2016 |
| CN | 205329374 | U | 6/2016 |
| CN | 205329380 | U | 6/2016 |
| CN | 205329384 | U | 6/2016 |
| DE | 3527724 | A1 | 2/1987 |
| DE | 3803195 | A1 | 8/1989 |

(56) References Cited

FOREIGN PATENT DOCUMENTS

| | | | |
|---|---|---|---|
| DE | 102006031355 | A1 | 1/2008 |
| EP | 0635595 | A1 | 1/1995 |
| EP | 2749685 | A1 | 7/2014 |
| GB | 2473224 | A | 3/2011 |
| WO | WO-2010/094959 | A1 | 8/2010 |
| WO | WO-2011/064581 | A1 | 6/2011 |
| WO | WO-2011/098815 | A1 | 8/2011 |
| WO | WO-2012/098408 | A2 | 7/2012 |
| WO | WO-2013/016902 | A1 | 2/2013 |
| WO | WO-2013/026233 | A1 | 2/2013 |
| WO | WO-2015/049541 | A1 | 4/2015 |
| WO | WO-2015/049544 | A1 | 4/2015 |
| WO | WO-2015/075479 | A1 | 5/2015 |

OTHER PUBLICATIONS

U.S. Appl. No. 15/737,407, Steele et al.
U.S. Appl. No. 15/748,234, Bird et al.
U.S. Appl. No. 16/481,583, Xeros Ltd.
U.S. Appl. No. 16/497,070, Xeros Ltd.
International Search Report and Written Opinion for International Application No. PCT/GB2014/050855, dated Aug. 22, 2014 (13 pages).
Search Report for United Kingdom Application No. GB1305121.4, dated Jul. 19, 2013 (3 pages).

* cited by examiner

DRYING APPARATUS AND METHOD

FIELD OF THE INVENTION

The present invention relates to an apparatus for use in the drying of substrates, most particularly textile fibres and fabrics, using solid particulate material. More specifically, the invention is concerned with an apparatus which provides for the use of such solid particulate material in a system adapted to optimise mechanical interaction between said particles and substrates, and which facilitates the easy removal of the particles from said substrates after completion of drying. The apparatus collects the solid particulate material which facilitates the re-use of the particles in subsequent substrate treatment operations such as washing. The present invention also relates to methods of drying a wet substrate using such apparatus and a solid particulate material.

BACKGROUND TO THE INVENTION

Tumble drying processes are a mainstay of both domestic and industrial textile fabric cleaning procedures and typically involve placing the textiles in a container such as a cylindrical drum which is rotated in alternating clockwise and anti-clockwise cycles whilst hot air is introduced into the drum. Domestic dryers typically comprise cylindrical drums having solid walls and the hot air is introduced at the rear of the drum, whilst the cylindrical drums in industrial dryers may have perforated side walls, such that the hot air may enter through the perforations. A combination of the hot air treatment and the mechanical action of the tumbling process causes water to be expelled from the textile materials in order that drying is achieved.

However, such processes, though generally very effective, are usually characterised by high levels of energy consumption, both in terms of effecting rotation of the container and, most particularly, in generating heated air. Typically, prior art processes may involve prolonged treatments at high temperatures in order to effect the required degree of drying. Clearly, however, the lower are the energy requirements of a system, the more efficient is the system and its associated drying process. Consequently, there is a desire to reduce both the time of such drying treatments and the temperature at which they are carried out in order to provide more efficient processes, whilst maintaining equivalent drying performance.

Current efficient domestic tumble dryers are graded in terms of energy consumption according to EU Directive 92/75/EEC and, more specifically, Directive 95/13/EEC, with category 'A' dryers being the most efficient, and category 'G' the least efficient. Hereinafter, energy consumptions are quoted for the cotton drying cycle for each machine type, in kWh/kg of drying load. Thus, for vented tumble dryers, 'A' class consumption is <0.51 kWh/kg, 'C' class (most common) is between 0.59 and 0.67 kWh/kg, whilst 'G' class is >0.91 kWh/kg. These values differ slightly for condenser tumble dryers, with 'A' class at <0.55 kWh/kg, 'C' class (most common) at between 0.64 and 0.73 kWh/kg, and 'G' class at >1.00 kWh/kg. With average domestic dryer capacities now at around 8.0 kg, this equates to a typical consumption for a 'C' class vented tumble dryer of 4.7-5.4 kWh/cycle; an 'A' class equivalent machine would run at <4.1 kWh/cycle. The most recent system in the EU (arising from Commission Delegated Regulation 392/2012, which entered into force on 29 May 2012 and will start applying from 29 May 2012) has, however, seen a switch to a new rating system for domestic tumble driers. This considers annualised energy consumption and derives an energy efficiency index (EEI), as well as introducing three new classes on top of class A, these being A+, A++ and A+++(most efficient). An EEI value of <24 results in an A+++ energy efficiency rating. Performance levels in the domestic sector generally set the highest standard for an efficient fabric drying process. Energy consumption in industrial tumble drying is usually higher, due to the need for faster cycle times. It is also noteworthy that, overall, tumble drying is significantly less efficient than washing as a component part of the laundry process in either sector.

Heating of the circulating air is the principal use of energy in such tumble dryers and the present inventors have therefore sought to effect improvements in the prior art processes by reducing the temperature levels required in such processes. This has been possible by means of changes made to the mechanical action of the process on the fabric in the drying load. Mechanical action in a conventional, horizontal axis tumble dryer is generated by the forces acting on the fabric through falling and hitting either other fabric or the dryer inner drum surface, whilst the fabric is interacting with the forced hot air flow. This results in release and evaporation of water from within the fabric, and hence drying. In the method herein provided, alteration of the mechanical action of the process in order to promote more localised release and evaporation of water at the fabric surface has resulted in lower drying temperatures. As a further potential benefit, it has been found that the changes made can also reduce the degree of fabric folding, and hence the level of creasing associated with tumble drying. Creasing, which concentrates stresses during this drying process, is a major source of localised fabric damage. Ironing at high temperatures is then the conventional means used to remove such creasing and this, too, brings a fabric damage penalty. Prevention of fabric damage (i.e. fabric care) is of primary concern to the domestic consumer and the industrial user. Furthermore, if creasing is reduced, there is also the secondary benefit to the user of convenience resulting from less ironing.

Hence, the present inventors sought to devise a new approach to the drying problem, which allows the above deficiencies associated with the methods of the prior art to be overcome and thereby provided a method which eliminates the requirement for the use of high drying temperatures for extended periods of time, but is still capable of providing an efficient means of water removal, so yielding economic and environmental benefits. The method also promotes fabric care through reduced creasing and fewer requirements for subsequent ironing.

Previously, in WO-A-2007/128962 there was disclosed a method and formulation for cleaning a soiled substrate, the method comprising the treatment of the moistened substrate with a formulation comprising a multiplicity of polymeric particles, wherein the formulation is free of organic solvents. In preferred embodiments, the substrate comprises a textile fibre and the polymeric particles may, for example, comprise particles of polyamides, polyesters, polyalkenes, polyurethanes or their copolymers, but are most preferably in the form of nylon particles.

The method disclosed in this document has been highly successful in providing an efficient means of cleaning and stain removal which also yields significant economic and environmental benefits due to its use of a cleaning formulation which requires the use of only limited amounts of water. The present inventors therefore sought to provide a drying process which adopts a similar approach to that disclosed in WO-A-2007/128962, and which offers benefits in terms of reduced energy requirements, whilst still providing an acceptable level of performance, and succeeded in achieving at least equivalent drying performance whilst employing significantly reduced process temperatures.

Thus, in WO-A-2012/098408 a process is provided wherein the drying effect achieved as a consequence of mechanical interaction of a wet substrate with physical media is optimised, such that excellent drying performance may be achieved at much lower temperatures (i.e. low energy) without extending drying times. Additional benefits have also been observed in terms of the reduction of fabric creasing and associated fabric damage. Specifically, there is provided a method for the drying of a wet substrate, said method comprising treating the substrate with a solid particulate material at ambient or elevated temperature, said treatment being carried out in an apparatus comprising a drum comprising perforated side walls, wherein said drum comprising perforated side walls is rotated so as to facilitate increased mechanical action between said substrate and said particulate material.

The method of WO-A-2012/098408 derives from an appreciation on the part of the inventors that optimum drying performance can be achieved as a result of improved mechanical interaction between substrate and physical media. This can be effected by the use of solid particles in the drying process and is a function of the number, size and mass of the particles and the free volume within the vessel in which the drying operation takes place, in addition to the G force dictated by its speed of rotation. Free volume in this context refers to the space inside the vessel which remains unoccupied by wet substrate or particulate media, and G force is defined on the basis of the centripetal forces which are acting.

Even though WO-A-2012/098408 describes a method which can dry a substrate effectively, the present inventors have now sought to provide an apparatus and method offering further improvements. In particular, the present invention attempts to solve, at least in part, one or more of the following problems: (i) removal and collection of the solid particulate material, (ii) improved drying efficiency, (iii) improved fabric care and (iv) reduced fabric creasing.

SUMMARY OF THE INVENTION

Thus, according to a first aspect of the present invention, there is provided an apparatus for use in the drying of substrates using a solid particulate material, said apparatus comprising:

(a) housing means having mounted therein a rotatably mounted cylindrical drum;

(b) access means; and (c) at least one collection means, wherein said rotatably mounted cylindrical drum additionally comprises capturing and transferring means, adapted to facilitate collection of said solid particulate material and transfer of said material to said at least one collection means.

In an embodiment of the invention, said drum has a capacity of between 5 and 50 litres for each kg of substrate. Typically, said drum is rotated at a speed which generates G forces in the range of from 0.05 to 0.99 G.

In certain embodiments of the invention, said rotatably mounted cylindrical drum comprises solid side walls including no perforations preferably such that, in operation, ingress and egress of any materials from the interior of drum is only possible via said capturing and transferring means to said at least one collection means. Such an arrangement is typically found in domestic dryers and certain industrial dryers.

In alternative embodiments of the invention, said rotatably mounted cylindrical drum comprises perforated side walls, wherein said perforations comprise holes having a diameter less than that of the particles of the solid particulate material. Typically, said perforations comprise holes having a diameter of no greater than 3.0 mm; thus, said perforations are adapted so as to prevent the egress of said solid particulate material. Such arrangements may be found in certain industrial dryers.

Typically, said capturing and transferring means comprises at least one receptacle comprising a first flow path facilitating ingress of solid particulate material from said rotatably mounted cylindrical drum and a second flow path facilitating transfer of said solid particulate material to said collection means.

In certain embodiments of the invention, said capturing and transferring means comprises one or a plurality of compartments.

In certain embodiments of the invention, said compartment or plurality of compartments may be located on at least one inner surface of said rotatably mounted cylindrical drum.

Embodiments of the invention envisage a plurality of compartments located, typically at equidistant intervals, on the inner circumferential surface of said rotatably mounted cylindrical drum.

Said capturing and transferring means is preferably adapted such that ingress of solid particulate material and transfer of said solid particulate material to said collection means may be controlled by the direction of rotation of said rotatably mounted cylindrical drum. Thus, in embodiments of the invention wherein said capturing and transferring means comprises at least one compartment comprising a flow path facilitating ingress of solid particulate material and transfer of said solid particulate material to said collection means, said ingress and transfer is dependent on said direction of rotation, and ingress of material does not occur when the direction of rotation is reversed.

Typically, said capturing and transferring means comprises routing means, adapted to direct the transference of said solid particulate material to said collection means.

In embodiments of the invention, said capturing and transferring means comprises regulating means. Said regulating means is typically located in the second floe path and is typically adapted to control the transfer of said solid particulate material to said collection means.

The present invention also envisages apparatus wherein said capturing and transferring means and said at least one collection means is retrofitted to apparatus of the prior art.

Said access means typically comprises a hinged door mounted in the casing, which may be opened to allow access to the inside of the cylindrical drum, and which may be closed in order to provide a substantially sealed system. Typically, the door includes a window.

Said rotatably mounted cylindrical drum is mounted horizontally within said housing means. Consequently, said access means is typically located in the front of the apparatus, providing a front-loading facility.

Rotation of said rotatably mounted cylindrical drum is effected by use of drive means, which typically comprises electrical drive means, in the form of an electric motor. Operation of said drive means is effected by control means which may be programmed by an operative.

Said rotatably mounted cylindrical drum is of the size which is to be found in most commercially available tumble dryers, and may have a capacity in the region of 10 to 7000 litres. Particular embodiments of the invention are concerned with domestic drying machines wherein a typical capacity would be in the region of 30 to 220 litres. However, other embodiments of the invention relate to industrial dryers, wherein capacities anywhere in the range of from 220 to 7000 litres are possible. In the context of the drying of textile substrates, a typical size in this range is that which is suitable for a 25 kg load, wherein the drum has a volume of 450 to 650 litres and, in such cases, said drum would generally comprise a cylinder with a diameter in the region of 75 to 120 cm, typically from 90 to 110 cm, and a length of between 40 and 100 cm, typically between 60 and 90 cm. Generally, the drum will have 20 litres of volume per kg of load to be dried.

In typical embodiments of the invention, said apparatus is designed to operate in conjunction with substrates and a solid particulate material, which is most preferably in the form of a multiplicity of polymeric particles or a mixture of polymeric and non-polymeric particles. These particles are typically required to be efficiently circulated to assist in promoting effective drying and the apparatus, therefore, typically includes circulation means. Thus, the inner surface of the cylindrical side walls of said rotatably mounted cylindrical drum typically comprises a multiplicity of spaced apart elongated protrusions affixed essentially perpendicularly to said inner surface. Typically said apparatus comprises from 3 to 10, most preferably 4, of said protrusions, which are commonly referred to as lifters. In operation, agitation of the contents of the rotatably mounted cylindrical drum is provided by the action of said lifters on rotation of said drum.

Particular embodiments of the invention envisage an apparatus as hereinbefore defined wherein said capturing and transferring means comprises a plurality of compartments located at equidistant intervals on the inner circumferential surface of said rotatably mounted cylindrical drum. In said embodiments, said plurality of compartments thereby additionally functions as a plurality of lifters.

Thus, in said embodiments, said lifters are adapted so as to capture said solid particulate material and to facilitate controlled transfer of solid particulate material between said lifter/capturing/transferring means and said at least one collection means. Most typically, said apparatus comprises a capturing compartment of essentially equal length to said lifter, and adapted so as to provide a first flow path from the compartment through an aperture in said lifter to the inside of said drum. Thus, in operation, for a given direction of rotation of said drum, particulate material present on the inner surface of said drum enters the lifters through the aperture and transports to the compartment housed therein via the first flow path; when the direction of rotation of said drum is reversed, entry of the solid particulate material into the compartment does not occur, or occurs to a lesser extent. Typically, said first flow path comprises a first aperture allowing ingress of solid particulate material into said capturing compartment and said second flow path comprises a second aperture allowing transfer of said solid particulate material to said at least one collection means. The dimensions of the apertures are selected in line with the dimensions of the solid particulate material, so as to allow efficient ingress and transfer thereof.

Said collection means typically comprises a container which acts as a receptacle for said solid particulate material. Said container is typically located adjacent an outer surface of said rotatably mounted cylindrical drum and may be positioned at any location on the circumference of said rotatably mounted cylindrical drum. In alternative embodiments, said collection means may be located adjacent an end surface of said rotatably mounted cylindrical drum. In said embodiments, said collection means may optionally be located adjacent the inner back surface of said rotatably mounted cylindrical drum, remote from the access means; alternatively, said collection means may be mounted externally to the front end of said rotatably mounted cylindrical drum.

In embodiments of the invention, wherein said collection means is located on the inner back end surface of said rotatably mounted cylindrical drum, said collection means typically comprises a cylindrical container arranged about the central axis of said drum and having a relatively large cross sectional area and small overall depth, such that the arrangement does not significantly adversely impact the internal volume of the rotatably mounted cylindrical drum. In embodiments of the invention wherein said collection means is mounted externally to the front end of said rotatably mounted cylindrical drum, said collection means may conveniently be comprised in the access means.

In typical embodiments of the invention, said apparatus comprises at least one recirculation means, thereby facilitating recirculation of said solid particulate material from said collection means to said rotatably mounted cylindrical drum, for re-use in drying operations. Typically, a first recirculation means comprises ducting connecting said collection means and said rotatably mounted cylindrical drum.

In said embodiments, recirculation of solid particulate material from said collection means to said rotatably mounted cylindrical drum may be achieved by the use of pumping means comprised in said first recirculation means, wherein said pumping means may typically be driven mechanically or pneumatically.

In operation, said apparatus is used for the drying of substrates and provides for the separation and recovery of said solid particulate material on completion of the drying process. Optionally, said solid particulate material may be continuously recirculated during the drying process. Said solid particulate material is collected in the collection means at the end of the process and may then be re-used in subsequent drying procedures.

In alternative applications, however, the solid particulate material which is collected in the collection means may be harvested and then utilised in washing machines for cleaning operations which rely on the use of solid particulate material. This approach is particularly relevant in the domestic machine market where it is difficult to achieve 100% separation of the solid particulate material from the wet substrates in a washer. In said applications, the solid particulate material is introduced into the dryer with the wet substrates and the additional volume of the dryer provides a sufficient increase in ullage to facilitate separation of particulate material at a level of >99% and, typically, removal rates approach, or actually reach, 100%. The apparatus is used to collect solid particulate material—which is carried over with the wet substrate from the cleaning operation in a matched pair washer—in the collection means, and it is harvested by removal therefrom. Typically, the collection means is physically detachable from the apparatus of the invention, allowing for simple and convenient harvesting of the solid particulate material by removal from the collection means, and its recycling into the matched pair washing machine for subsequent cleaning operations.

According to a second aspect of the present invention, there is provided a method for the drying of a wet substrate, said method comprising treating the substrate with a solid particulate material at ambient or elevated temperature, said treatment being carried out in an apparatus according to a first aspect of the invention.

The substrate preferably is, or comprises, at least one textile fibre which is typically in the form of a textile fibre garment.

Typically, said method comprises the steps of:

(a) introducing at least one wet substrate into said rotatably mounted cylindrical drum via access means;

(b) closing the access means so as to provide a substantially sealed system;

(c) introducing solid particulate material into said rotatably mounted cylindrical drum;

(d) operating the apparatus for a drying cycle, wherein said rotatably mounted cylindrical drum is caused to rotate and said solid particulate material is optionally recirculated through the apparatus until drying is completed;

(e) causing said rotatably mounted cylindrical drum to rotate so as to cause solid particulate material to be captured by said capturing and transferring means and thereby transferred to said collection means; and (f) ceasing rotation of said rotatably mounted cylindrical drum.

Optionally, on completion of the drying operation, said collection means may be removed from said apparatus and said solid particulate material may be harvested for re-use in cleaning operations requiring the use of solid particulate material in a suitable washing machine. This approach is particularly suited to embodiments of the invention wherein solid particulate material is introduced into the dryer with the wet substrate from a washer using solid particulate material; on completion of the drying operation, the collection means may be removed from the apparatus and the solid particulate material can then be harvested for re-use in cleaning operations in a matched pair washing machine that requires the use of solid particulate material, as previously discussed.

Typically, said solid particulate material comprises a multiplicity of particles which may be polymeric, non-polymeric or mixtures thereof, and which may be added at a particle to fabric addition level of 0.1:1-10:1 by mass.

The size of said particles, in combination with their material density and the total particle to fabric addition level, determines the number of particles which are present in a process according to the invention. Each particle may have a smooth or irregular surface structure, can be of solid or hollow construction, and is of such a shape and size to allow for good flowability and intimate contact with the soiled substrate, which typically comprises a textile fabric. A variety of shapes of particles can be used, such as cylindrical, spherical or cuboid; appropriate cross-sectional shapes can be employed including, for example, annular ring, dog-bone and circular. Most preferably, however, said particles comprise cylindrical or spherical particles.

Polymeric particles typically have an average density in the range of 0.5-2.5 g/cm$^3$, more typically from 0.55-2.0 g/cm$^3$, more typically from 0.6-1.9 g/cm$^3$. Non-polymeric particles generally have an average density in the range of from 3.5-12.0 g/cm$^3$, more typically from 5.0-10.0 g/cm$^3$, most typically from 6.0-9.0 g/cm$^3$. The average volume of both the non-polymeric and polymeric particles is typically in the range of 5-275 mm$^3$, more typically from 8-140 mm$^3$, most typically from 10-120 mm$^3$.

In the case of cylindrical particles—both polymeric and non-polymeric—of oval cross section, the major cross section axis length, a, is typically in the range of from 2.0-6.0 mm, more typically from 2.2-5.0 mm, most typically from 2.4-4.5 mm, and the minor cross section axis length, b, is typically in the range of from 1.3-5.0 mm, more typically from 1.5-4.0 mm, and most typically from 1.7-3.5 mm (a>b). The length of such particles, h, is typically from 1.5-6.0 mm, more typically from 1.7-5.0 mm, and most typically from 2.0-4.5 mm (h/b is typically in the range of from 0.5-10).

For cylindrical particles—both polymeric and non-polymeric—of circular cross section, the typical cross section diameter, $d_c$, is in the range of from 1.3-6.0 mm, more typically from 1.5-5.0 mm, and most typically from 1.7-4.5 mm. The typical length, $h_c$, of such particles is again from 1.5-6.0 mm, more typically from 1.7-5.0 mm, and most typically from 2.0-4.5 mm ($h_c/d_c$ is typically in the range of from 0.5-10).

In the case of both polymeric and non-polymeric spherical particles (not perfect spheres) the diameter, $d_s$, is typically in the range of from 2.0-8.0 mm, more typically in the range of from 2.2-5.5 mm, and most typically from 2.4-5.0 mm.

In embodiments where the particles, whether polymeric or non-polymeric, are perfect spheres, the diameter, $d_{ps}$, is typically in the range of from 2.0-8.0 mm, more typically from 3.0-7.0 mm, and most typically from 4.0-6.5 mm.

Polymeric particles may comprise either foamed or unfoamed polymeric materials. Furthermore, the polymeric particles may comprise polymers which are either linear or crosslinked.

Preferred polymeric particles comprise polyalkenes such as polyethylene and polypropylene, polyamides, polyesters or polyurethanes. Preferably, however, said polymeric particles comprise polyamide or polyester particles, most particularly particles of nylon, polyethylene terephthalate or polybutylene terephthalate.

Optionally, copolymers of the above polymeric materials may be employed for the purposes of the invention. Specifically, the properties of the polymeric materials may be tailored to individual requirements by the inclusion of monomeric units which confer particular properties on the copolymer. Thus, the copolymers may be adapted to attract moisture by comprising monomers which, inter alia, are hydrophilic through being ionically charged or including polar moieties or unsaturated organic groups.

Non-polymeric particles may comprise particles of glass, silica, stone, wood, or any of a variety of metals or ceramic materials. Suitable metals include, but are not limited to, zinc, titanium, chromium, manganese, iron, cobalt, nickel, copper, tungsten, aluminium, tin and lead, and alloys thereof. Suitable ceramics include, but are not limited to, alumina, zirconia, tungsten carbide, silicon carbide and silicon nitride. It is seen that non-polymeric particles made from naturally occurring materials (e.g. stone) can have various shapes, depending on their propensity to cleave in different ways during manufacture.

In further embodiments of the invention, said non-polymeric particles may comprise coated non-polymeric particles. Most particularly, said non-polymeric particles may comprise a non-polymeric core material and a shell comprising a coating of a polymeric material. In a particular embodiment, said core may comprise a metal core, typically a steel core, and said shell may comprise a polyamide coating, for example a coating of nylon.

In accordance with the present invention, the selection of specific particle type (polymeric and non-polymeric) for a given drying operation is particularly significant in optimising fabric care. Thus, particle size, shape, mass and material must all be considered carefully in respect of the particular substrate which is to be dried, so that particle selection is dependent on the nature of the garments to be dried, i.e. whether they comprise cotton, polyester, polyamide, silk, wool, or any of the other common textile fibres or blends which are commonly in use.

The generation of suitable G forces, in combination with the action of the solid particulate material, is a key factor in achieving an appropriate level of mechanical action on the wet substrate. G is a function of the drum size and the speed of rotation of the drum and, specifically, is the ratio of the centripetal force generated at the inner surface of the drum to the static weight of the wet substrate. Thus, for a drum of inner radius r (m), rotating at R (rpm), with a load of mass M (kg), and an instantaneous tangential velocity of the drum v (m/s), and taking g as the acceleration due to gravity at 9.81 $m/s^2$:

$$\text{Centripetal force}=Mv^2/r$$

$$\text{Load static weight}=Mg$$

$$v=2\pi rR/60$$

$$\text{Hence, } G=4\pi^2r^2R^2/3600rg=4\pi^2rR^2 3600g=1.118\times10^{-3}rR^2$$

When, as is usually the case, r is expressed in centimetres, rather than metres, then:

$$G=1.118\times10^{-5}rR^2$$

Hence, in a preferred embodiment of the invention, for a drum of radius 37 cm (diameter 74 cm) rotating at 48 rpm, G=0.95. Typically, for such a drum, optimum speeds of rotation are in the range of from 10 to 49 rpm.

Said drying process also comprises the introduction of either ambient or heated air into said drum. If said air is heated, this is achieved by means of any commercially available air heater and circulated using a fan so as to achieve a temperature of between 5° and 120° C., preferably between 10° and 90° C., most preferably between 20° and 80° C. in the apparatus. The temperature of ambient air is dependent on the surroundings in which the drying process is running, but this can typically vary from 5-20° C.

It should be particularly noted that heating the air naturally results in heating of the particulate media in the drying process. This heat then is retained by the particles on completion of a drying cycle and, hence, if the next drying cycle occurs within the time taken for the particles to cool down, there will be a transfer of this retained heat to that subsequent drying process. There is, therefore, an even greater level of drying efficiency achievable in the event that multiple drying cycles are run consecutively. This is, of course, applicable to both the domestic and industrial laundry sectors—but, most particularly, to the latter. Rapid turnaround of drying cycles and high load throughput are both key factors in this kind of drying operation in an industrial scenario.

As a consequence of employing the method of the present invention, excellent drying performance may be achieved whilst using reduced temperatures (i.e. lower energy consumption), without increasing drying times. Thus, drying operations according to the invention are typically carried out at temperatures which are 20° C. lower than with prior art processes, whilst achieving equivalent drying performance for the same time of treatment.

During the cycle for capturing said solid particulate material, rotation of said rotatably mounted cylindrical drum is typically caused to occur at rotation speeds such that G is <1 which, for a 98 cm diameter drum, requires a rotation speed of up to 42 rpm, with preferred rates of rotation being between 30 and 40 rpm.

BRIEF DESCRIPTION OF THE DRAWINGS

The invention will now be further illustrated by reference to the following drawings, wherein.

DETAILED DESCRIPTION OF THE INVENTION

Figure 1:
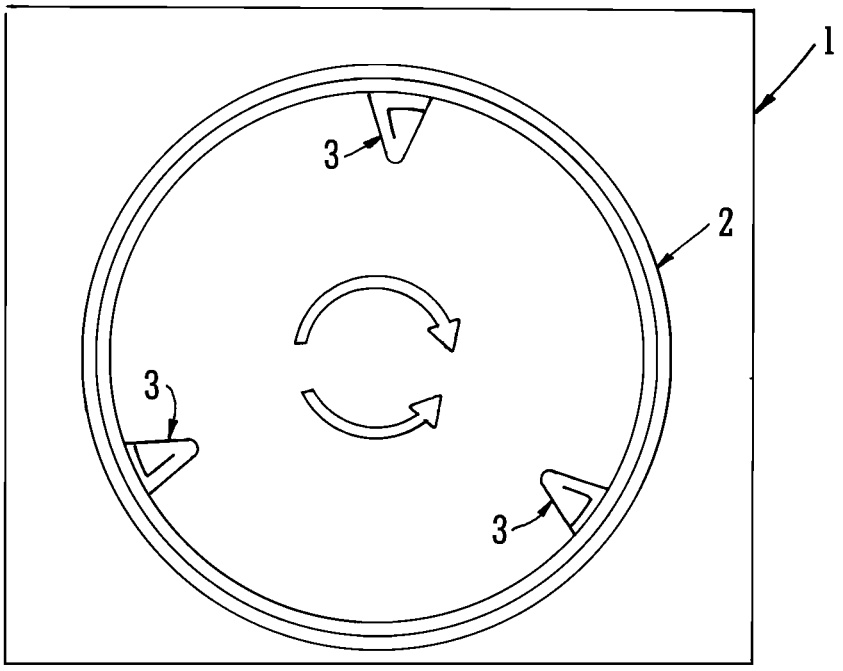
FIG. 1 shows a schematic representation of a rotatably mounted cylindrical drum in an apparatus according to an embodiment of the invention.

In apparatus employed in the method of the invention, said access means typically comprises a hinged door mounted in the casing, which may be opened to allow access to the inside of the cylindrical drum, and which may be closed in order to provide a substantially sealed system. Typically, the door includes a window.

Said rotatably mounted cylindrical drum is typically mounted horizontally within said housing means. Consequently, in said embodiments of the invention, said access means is located in the front of the apparatus, providing a front-loading facility.

Rotation of said rotatably mounted cylindrical drum is effected by use of drive means, which typically comprises electrical drive means, in the form of an electric motor. Operation of said drive means is effected by control means which may be programmed by an operative.

Said rotatably mounted cylindrical drum is of the size which is to be found in most domestic or industrial tumble dryers, and may have a capacity in the region of 50 to 7000 litres. A typical capacity for a domestic machine would be in the region of 80 to 220 litres and, for an industrial machine, this range would typically be from 220 to 2000 litres.

Said at least one collection means typically comprises a container which acts as a receptacle for said solid particulate material. Said container may optionally be located adjacent an outer surface of said rotatably mounted cylindrical drum and may be positioned at any location on the circumference of said rotatably mounted cylindrical drum. In alternative embodiments, said collection means may be located adjacent an end surface of said rotatably mounted cylindrical drum. In said embodiments, said collection means may optionally be located adjacent the inner back surface of said rotatably mounted cylindrical drum, remote from the access means; alternatively, said collection means may be mounted externally to the front end of said rotatably mounted cylindrical drum.

In embodiments of the invention, wherein said collection means is located on the inner back end surface of said rotatably mounted cylindrical drum, said collection means typically comprises a cylindrical container arranged about the central axis of said drum and having a relatively large cross sectional area and small overall depth, such that the arrangement does not significantly adversely impact the internal volume of the rotatably mounted cylindrical drum. In said embodiments, in order that said collection means does not significantly adversely impact the internal volume of the rotatably mounted cylindrical drum, said collection means may also comprise channels to allow said solid particulate material to flow from said capturing and transferring means to said container. In embodiments of the invention wherein said collection means is mounted externally to the front end of said rotatably mounted cylindrical drum, said collection means may conveniently be comprised in the access means.

Said capturing and transferring means is adapted to facilitate capture of said solid particulate material in said rotatably mounted cylindrical drum and transfer of said material to said at least one collection means, Said capturing and transferring means comprises at least one receptacle comprising a first flow path facilitating ingress of solid particulate material from said rotatably mounted cylindrical drum and a second flow path facilitating transfer of said solid particulate material to said collection means.

In certain embodiments of the invention, said capturing and transferring means comprises one or a plurality of compartments which are located on at least one inner surface of said rotatably mounted cylindrical drum. Typically, said capturing and transferring means comprises a plurality of compartments located, typically at equidistant intervals, on the inner circumferential surface of said rotatably mounted cylindrical drum and, in said embodiments, said plurality of compartments thereby additionally functions as a plurality of lifters.

Thus, in said embodiments, said lifters are adapted so as to capture said solid particulate material and to facilitate controlled transfer of solid particulate material between said lifter/capturing/transferring means and said at least one collection means. Most typically, said apparatus comprises a capturing compartment of essentially equal length to said lifter, and adapted so as to provide a first flow path from the compartment through an aperture in said lifter to the inside of said drum and a second flow path through the circumferential surface of said drum to said collection means.

Typically, said first flow path comprises a first aperture allowing ingress of solid particulate material into said capturing compartment and said second flow path comprises a second aperture allowing transfer of said solid particulate material to said at least one collection means. The dimensions of the apertures are selected in line with the dimensions of the solid particulate material, so as to allow efficient ingress and transfer thereof.

Said capturing and transferring means is typically adapted such that ingress of solid particulate material may be controlled by the direction of rotation of said rotatably mounted cylindrical drum. Thus, in embodiments of the invention wherein said capturing and transferring means comprises at least one compartment comprising a flow path facilitating ingress of solid particulate material and transfer of said solid particulate material to said collection means, said ingress is dependent on said direction of rotation; subsequent transfer of said solid particulate material to said collection means is optionally controlled by said regulating means.

Typically, said capturing and transferring means comprises routing means, adapted to direct the transference of said solid particulate material along said second flow path to said collection means.

Said second flow path may optionally comprise at least one orifice in the side wall of said rotatably mounted cylindrical drum having a diameter which allows said solid particulate material to transfer to said collection means. In certain embodiments of the invention, said second flow path may comprise regulating means.

Said routing means may comprise any suitable means for causing said solid particulate material to be transferred from said capturing and transferring means to said collection means. Thus, for example, in certain embodiments of the invention, said routing means may comprise a directionally inclined member which causes said solid particulate matter to be moved in a particular direction. A simple example would be an inclined surface along which the material is transported.

Thus, in embodiments of the invention wherein said capturing and transferring means comprises lifters spaced on the inner circumferential walls of the rotatably mounted cylindrical drum, said lifters may conveniently comprise a sloping surface. In embodiments of the invention wherein the second flow path by which the solid particulate material is transferred to the collection means, together with any optional regulating means, is located at the rear of the drum, said sloping surface may be inclined from front to rear of the rotatably mounted cylindrical drum, thereby causing said solid particulate material to be directed to the rear of the drum. Alternatively, in those embodiments wherein the second flow path, and any optional regulating means, is located at the front of the drum, said lifters may comprise a sloping surface which is inclined from rear to front of the rotatably mounted cylindrical drum, thereby causing said solid particulate material to be directed to the front of the drum; such an arrangement is also applicable to embodiments wherein the collection means is itself located at the front of the drum, for example in the access means.

In alternative embodiments of the invention, wherein said capturing and transferring means is comprised in the lifters said lifters may comprise routing means comprising a plurality of compartments each of which comprises a plurality of opposed offset chambers, arranged along each side of the inner walls of the lifters, preferably such that, in operation, rotation of the drum causes solid particulate material to be transferred from one side of the lifter to the other into a chamber which is partly offset from an opposite chamber, such that said material is caused to be transported along the length of the lifter.

In further alternative embodiments of the invention, said capturing and transferring means may comprise routing means comprising an Archimedian screw which is typically adapted so as to transport said solid particulate material along the length of the capturing and transferring means. Such an arrangement is again particularly suitable for application in embodiments of the invention wherein said capturing and transferring means is comprised in lifters.

Yet further embodiments of the invention envisage an arrangement wherein said capturing and transferring means comprises an inner cylindrical drum skin, which is located within, and concentric with, said rotatably mounted cylindrical drum. In said embodiments, which are particularly suitable for industrial dryers, said inner cylindrical drum skin comprises perforations having a diameter such that egress of said solid particulate material may occur into the space between the outer surface of said inner cylindrical drum skin and the inner surface of said rotatably mounted cylindrical drum. Additionally, in said embodiments, the outer surface of said inner cylindrical drum skin comprises routing means in the form of an Archimedian spiral, adapted so as to transport said solid particulate material in the space between the outer surface of said inner cylindrical drum skin and the inner surface of said rotatably mounted cylindrical drum to the collection means.

In certain embodiments of the invention, said capturing and transferring means comprises regulating means, adapted to control the transfer of said solid particulate material to said collection means.

Said regulating means is located in said second flow path and is adapted to control the flow of solid particulate material to the collection means. Said regulating means may conveniently be provided in the form of an openable door or flap, typically which is adapted to release said solid particulate material into said collection means.

In embodiments of the invention, said door or flap may be caused to open and release said solid particulate cleaning material into said storage means by actuating means which may comprise mechanical means, electrical means or magnetic means. Thus, for example, said door or flap may incorporate a protrusion which interacts with said storage means during the course of rotation of the rotatably mounted cylindrical drum to cause the door or flap to open. Typically in such cases, said door or flap would comprise, for example, spring loading to hold the door in the closed position, until the protrusion abuts the storage means and the consequent interaction provides a force to act against the action of the spring, thereby causing the door to open. Once the interaction of the protrusion with the storage means ceases, as rotation of the drum continues, the force is removed and the door or flap returns to the closed position.

In further embodiments of the invention, said regulating means may be provided in the form of a revolving door which is typically adapted to release said solid particulate material into said collection means. In said embodiments, said door typically comprises two intersecting rigid members in the form of a cross incorporating a pin or other suitable member, inserted along the plane of intersection of the rigid members, and about which rotation of the door may occur. Said door is typically mounted in the surface of the rotatably mounted cylindrical drum and is caused to open and close by said actuating means which may optionally, for example, comprise mechanical means involving interaction with the collection means, located externally of the drum, during rotation of said drum, thereby causing said solid particulate material to be released from said drum and transferred to said collection means. In certain embodiments the regulating means comprises a repository wherein said solid particulate material may collect.

As previously stated, the invention also envisages embodiments wherein said solid particulate material is able to be transferred directly to said collection means without the requirement for regulating means. Such an embodiment is particularly suitable for embodiments of the invention wherein said capturing and transferring means includes routing means comprising an inclined surface along which said material is transported.

In operation, said apparatus is used for the drying of substrates and provides for optional continuous recirculation of the solid particulate material until completion of the drying process, after which the particles comprised in the solid particulate material may be separated and collected in the collection means for re-use in subsequent procedures.

In alternative applications, however, the solid particulate material may be harvested and utilised in washing machines for cleaning operations which rely on the use of solid particulate material and such an approach is particularly relevant in the domestic machine market. In such applications, the solid particulate material is introduced into the dryer with the wet substrates and, on completion of the drying process, the apparatus is used to collect solid particulate material carried over with the wet substrate from the cleaning operation in the collection means, from where it may be harvested. Typically, the collection means is physically detachable from the apparatus of the invention, allowing for simple and convenient harvesting of the solid particulate material by removal from the collection means, and its recycling into the matched pair washing machine, or other washing machine, for subsequent cleaning operations.

Said rotatably mounted cylindrical drum is typically located within a first upper chamber of said housing means and beneath said first upper chamber is located a second lower chamber which may optionally comprise said collection means.

Said housing means is optionally connected to standard plumbing features, thereby providing recirculation means for returning said solid particulate material from said collection means, and delivery means, by virtue of which said solid particulate material may be returned to said cylindrical drum.

In operation according to the method of the second aspect of the invention, agitation is provided by rotation of said rotatably mounted cylindrical drum and by the introduction of heated air. Thus, said apparatus additionally comprises means for circulating air within said housing means, and for adjusting the temperature therein. Said means may typically include, for example, a recirculating fan and an air heater. Additionally, sensing means may also be provided for determining the temperature and humidity levels within the apparatus, and for communicating this information to the control means.

As stated above, said apparatus may optionally comprise recirculation means, thereby facilitating optional recirculation of said solid particulate material from said lower chamber to said rotatably mounted cylindrical drum, for re-use in drying operations. Preferably, said recirculation means comprises ducting connecting said second chamber and said rotatably mounted cylindrical drum. More preferably, said ducting comprises control means, adapted to control entry of said solid particulate material into said cylindrical drum. Typically, said control means comprises a valve located in feeder means, preferably in the form of a feed tube attached to the apex of a receptor vessel located above, and connected to the interior of, said cylindrical drum.

Recirculation of solid particulate matter from said lower chamber to said rotatably mounted cylindrical drum may be achieved by the use of pumping means comprised in said recirculation means, wherein said pumping means are adapted to deliver said solid particulate matter to said control means, adapted to control the re-entry of said solid particulate matter into said rotatably mounted cylindrical drum. Said pumping means may typically be driven mechanically or pneumatically and may, for example, comprise a vacuum pumping system.

In operation, during a typical cycle according to the method of the second aspect of the invention, cleaned garments containing residual moisture are first placed into said rotatably mounted cylindrical drum. The cylindrical drum is caused to rotate and ambient or heated air is introduced into the drum before the solid particulate material is added. During the course of agitation by rotation of the drum, water is caused to be removed from the garments by evaporation and a quantity of the solid particulate material may be captured by the capturing and transferring means and thence transferred to the collection means. On completion of the drying cycle, the solid particulate material is completely removed from the dried garments and transferred to the collection means.

In embodiments of the invention where said apparatus comprised recirculation means, said solid particulate material may optionally be recirculated via the recirculation means such that it is returned, in a manner controlled by said control means, to the cylindrical drum during the drying operation. In said embodiments, this process of continuous circulation of the solid particulate material occurs throughout the drying operation until drying is completed.

On completion of the cycle any optional feeding of solid particulate material into the rotatably mounted cylindrical drum ceases, but rotation of the drum continues so as to allow for removal of the solid particulate material by capture, transfer and collection in the collection means. Air heating and recirculation may also be stopped at this point. After separation, the solid particulate material is recovered in order to allow for re-use in subsequent operations. Said separation of particulate material removes >99% of these particles, and typically removal rates approach, or actually reach, 100%.

Generally, any remaining solid particulate material on said at least one substrate may be easily removed by shaking the at least one substrate. If necessary, however, further remaining solid particulate material may be removed by suction means, preferably comprising a vacuum wand.

The method of the invention may be applied to the drying of any of a wide range of substrates including, for example, plastics materials, leather, metal or wood. In practice, however, said method is principally applied to the drying of wet substrates comprising textile fibres and fabrics, and has been shown to be particularly successful in achieving efficient drying of textile fabrics which may, for example, comprise either natural fibres, such as cotton, or man-made and synthetic textile fibres, for example nylon 6,6, polyester, cellulose acetate, or fibre blends thereof.

Most preferably, the solid particulate material comprises a multiplicity of particles which may be polymeric, non-polymeric, or mixtures thereof. Typical polymeric particles may comprise polyamide or polyester particles, most particularly particles of nylon, polyethylene terephthalate or polybutylene terephthalate, or copolymers thereof, most preferably in the form of beads, which may be solid or hollow in their structure. The polymers may be foamed or unfoamed, and may be linear or crosslinked. Various nylon or polyester homo- or co-polymers may be used including, but not limited to, Nylon 6, Nylon 6,6, polyethylene terephthalate and polybutylene terephthalate. Preferably, the nylon comprises Nylon 6,6 polymer, preferably having a molecular weight in the region of from 5000 to 30000 Daltons, more preferably from 10000 to 20000 Daltons, most preferably from 15000 to 16000 Daltons. The polyester will typically have a molecular weight corresponding to an intrinsic viscosity measurement in the range of from 0.3-1.5 dl/g as measured by a solution technique such as ASTM D-4603.

Suitable non-polymeric particles may comprise particles of glass, silica, stone, wood, or any of a variety of metals or ceramic materials. Suitable metals include, but are not limited to, zinc, titanium, chromium, manganese, iron, cobalt, nickel, copper, tungsten, aluminium, tin and lead, and alloys thereof. Suitable ceramics include, but are not limited to, alumina, zirconia, tungsten carbide, silicon carbide and silicon nitride. It is seen that non-polymeric particles made from naturally occurring materials (e.g. stone) can have various shapes, depending on their propensity to cleave in different ways during manufacture.

Said solid particulate cleaning material may be comprised entirely of polymeric particles or entirely of non-polymeric particles, or may comprise mixtures of both types of particles. In embodiments of the invention wherein said solid particulate cleaning material comprises both polymeric particles and non-polymeric particles, the ratio of polymeric particles to non-polymeric particles may be anywhere from 99.9%:0.1% to 0.1%:99.9% w/w. Certain embodiments envisage ratios of from 95.0%:5.0% to 5.0%:95.0% w/w, or from 80.0%:20.0% to 20.0%:80.0% w/w, of polymeric particles to non-polymeric particles.

The ratio of solid particulate material to substrate is generally in the range of from 0.1:1 to 10:1 w/w, preferably in the region of from 1.0:1 to 7:1 w/w, with particularly favourable results being achieved using polymeric particles at a ratio of between 3:1 and 5:1 w/w, and especially at around 4:1 w/w. Thus, for example, for the drying of 5 g of fabric, 20 g of polymeric particles would be employed in one embodiment of the invention. The ratio of solid particulate material to substrate is maintained at a substantially constant level throughout the drying cycle.

The method of the present invention may be used for either small or large scale batchwise processes and finds application in both domestic and industrial drying processes. By small scale in this context is typically meant less than or equal to 220 drying cycles per year, whilst large scale typically means more than 220 drying cycles per year.

As previously noted, the method of the invention finds particular application in the drying of textile fabrics. The conditions employed in such a system do, however, allow the use of significantly reduced temperatures from those which typically apply to the conventional tumble drying of textile fabrics and, as a consequence, offer significant environmental and economic benefits. Thus, typical procedures and conditions for the drying cycle require that fabrics are generally treated according to the method of the invention at, for example, temperatures of between 20 and 80° C., typically for a duration of between 5 and 55 minutes. Thereafter, additional time is required for the completion of the particle separation stage of the overall process, so that the total duration of the entire cycle is typically in the region of 1 hour.

The results obtained are very much in line with those observed when carrying out conventional tumble drying procedures with textile fabrics. The extent of water removal achieved with fabrics treated by the method of the invention is seen to be very good. The temperature requirement is significantly lower than the levels associated with the use of conventional tumble drying procedures, again offering significant advantages in terms of cost and environmental benefits.

The method of the invention also shows benefits in terms of reducing drying-related fabric damage. As previously observed, fabric creasing readily occurs in conventional tumble drying, and this acts to concentrate the stresses from the mechanical action of the drying process at each crease, resulting in localised fabric damage. Prevention of such fabric damage (or fabric care) is of primary concern to the domestic consumer and industrial user. The addition of particles according to the method of the invention effectively reduces creasing in the process by acting as a pinning layer on the fabric surface in order to help prevent the folding action. The particles also inhibit interaction between separate pieces of fabric in the drying process by acting as a separation or spacing layer, thereby reducing entanglement which is another major cause of localised fabric damage. In the presently disclosed method, mechanical action is still present but, critically, this is much more uniformly distributed as a result of the action of the particles. It is the localised aspect of the damage that determines the lifetime of a garment under multiple drying processes.

Thus, the method of the present invention provides for enhanced performance in comparison with the methods of the prior art under equivalent energy conditions; alternatively, equivalent drying performance may be achieved at lower levels of energy, together with reduced fabric damage.

The rate of exit of the solid particulate material from the rotatably mounted cylindrical drum is affected by the speed of rotation of said drum, with higher rotation speeds increasing the G force, although at G>1 the fabric adheres to the sides of the drum and prevents exit of the particulate material. Hence, slower rotational speeds have been found to provide optimum results in this regard, as they allow the particles to fall from the fabric and be captured by the capturing and transferring means as the fabric opens out more during tumbling. Rotational speeds resulting in a G force of <1 are therefore required (<42 rpm in a 98 cm diameter drum, for example). The G force (or rotational speed) is also controlled so as to maximise the beneficial effect of the mechanical action of the particulate material on the substrate, and the most suitable G is generally found to be in the region of 0.9 G (e.g. 40 rpm in a 98 cm diameter drum).

On completion of the drying cycle, the rotation G and rotational speed are maintained at the same values of <1 and low or lower (20) rpm as in the drying cycle in order to effect complete removal of particulate material; this removal of particles generally takes around 5-20 minutes, with the drying cycle in a typical operation typically taking 40-55 minutes, giving a total overall cycle time in the region of 1 hour.

The method of the invention has been shown to be successful in the removal of particulate material from the dried substrate after processing and tests with cylindrical polyester particles, and nylon particles comprising either Nylon 6 or Nylon 6,6 polymer, have indicated particle removal efficacy such that on average <5 particles per garment remain in the load at the end of the particle separation cycle. Generally, this can be further reduced to an average of <2 particles per garment and, in optimised cases wherein a 20 minute separation cycle is employed, complete removal of particles is typically achieved.

Additionally, it has been demonstrated that re-utilisation of the particles in the manner described operates well, so that particles can be satisfactorily re-used in subsequent drying procedures. Indeed re-utilisation in further drying procedures offers further advantages in terms of energy efficiency, as heating the air naturally results in heating of the particulate media in the drying process. This heat then is retained by the particles on completion of a drying cycle and, hence, if the next drying cycle occurs within the time taken for the particles to cool down, there will be a transfer of this retained heat to that subsequent drying process. There is, therefore, an even greater level of drying efficiency achievable in the event that multiple drying cycles are run consecutively. This is, of course, applicable to both the domestic and industrial laundry sectors—but, most particularly, to the latter. Rapid turnaround of drying cycles and high load throughput are both key factors in this kind of drying operation in an industrial scenario. The invention also envisages the collection of solid particulate material introduced into the dryer with a wet substrate from a suitable washing machine, which may then be re-utilised in subsequent cleaning operations, as previously described.

The method of the invention is believed to comprise the mechanical action of the particles against a cloth so as to liberate the moisture trapped between fibres, and the pick up of this moisture on the particle surface, wherein rapid evaporation occurs of the thin film of water which is formed. Certain polymeric particles also have the ability to absorb moisture to a larger extent (Nylon 6 and Nylon 6,6 being examples). It may be the case, therefore, that some such absorption is also contributing to the drying mechanism.

Referring now to the Figures, there is seen in FIG. 1 an apparatus according to the invention comprising housing means (1) in which is located a rotatably mounted cylindrical drum in the form of drum (2) wherein the apparatus comprises capturing and transferring means in the form of lifters (3).

Figure 2:
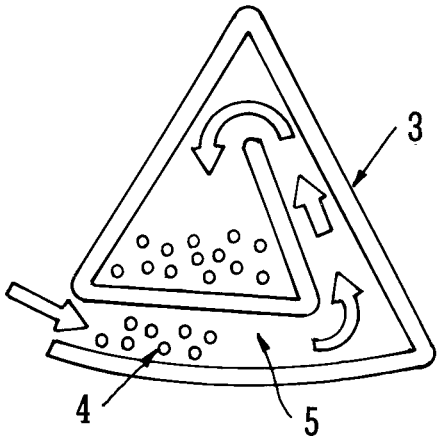
FIG. 2 shows the design of a lifter functioning as part of capturing and transferring means in an apparatus according to an embodiment of the invention.

A close up view of the capturing action of a lifter (3) is shown in FIG. 2 wherein solid particulate material (4) enters the lifter via a first flow path (5).

Figure 3:
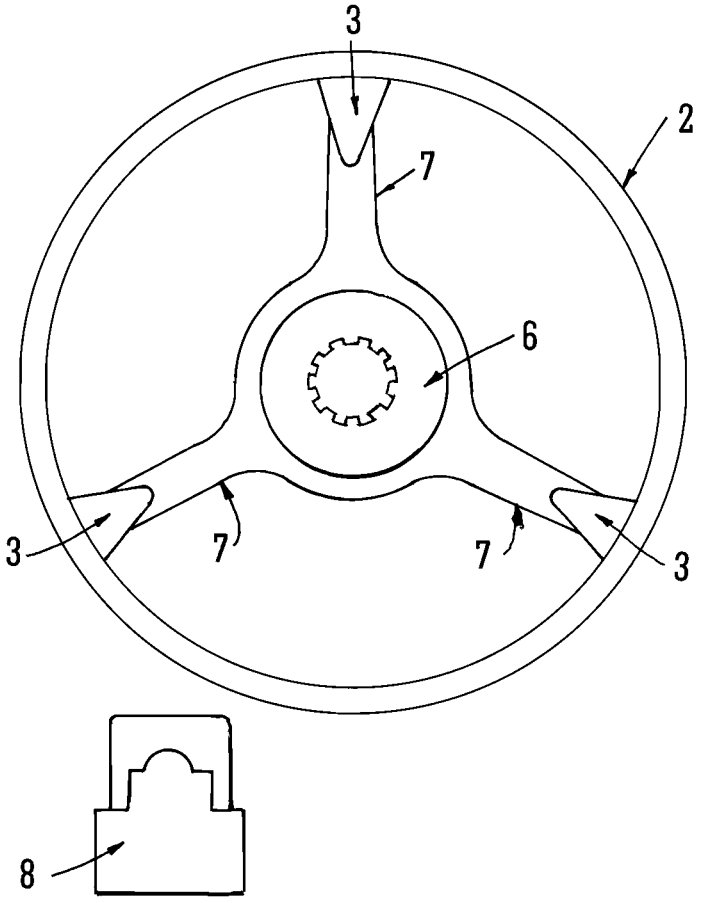
FIG. 3 shows an embodiment wherein the collection means is located at the rear of a rotatably mounted cylindrical drum in an apparatus according to the invention.

FIG. 3 shows an embodiment of the invention wherein the collection means is located on the inner back end surface of the rotatably mounted cylindrical drum and comprises a cylindrical container (6) arranged about the central axis of the drum (2) and channels (7) which allow solid particulate material to flow from lifters (3) to the container. Rotation of the drum is controlled by motor (8).

Figure 4:
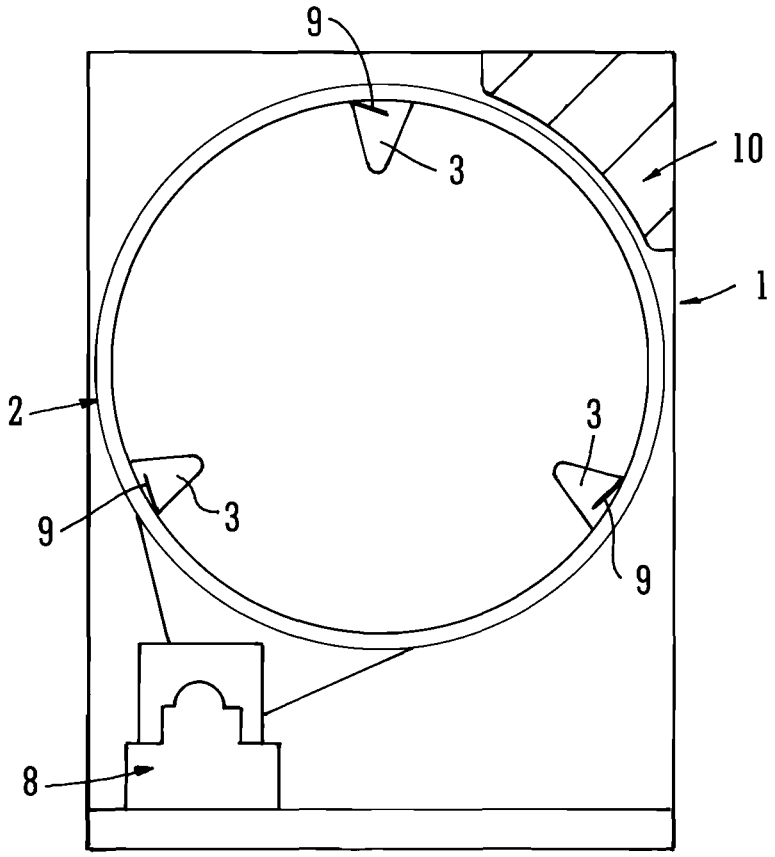
FIG. 4 illustrates an embodiment wherein the collection means is located adjacent an upper external surface of a rotatably mounted cylindrical drum in an apparatus according to the invention.

Referring now to FIG. 4, there is shown an apparatus according to the invention comprising housing means (1) having mounted therein a rotatably mounted cylindrical drum (2) and drive motor (8) located beneath said cylindrical drum. The apparatus additionally comprises capturing and transferring means comprising lifters (3) having regulating means in the form of doors (9) in a second flow path through which solid particulate material is able to enter the collection means. The collection means comprises container (10) which is located above an upper circumferential face of the drum.

Figure 5:
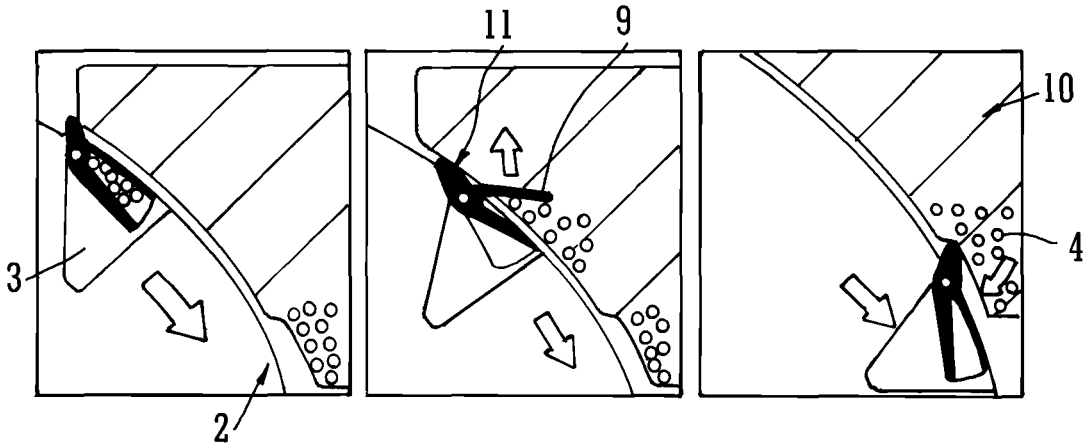
FIG. 5 shows the mode of operation of an embodiment of capturing and transferring means comprised in the apparatus of the invention.

Turning to FIG. 5, there is seen an illustration of the means for release of the solid particulate material from the capturing compartment of a lifter (3) into container (10) for an apparatus as shown in FIG. 4. Thus, in step 1, it is seen that door (9) comprises a U-shaped member in which solid particulate material (4) accumulates. Then, in step 2, as the drum (2) rotates, protrusion (11) on the regulating means interacts with the surface of the container (10), causing the solid particulate material (4) to be deposited in the storage means. Finally, in step 3, as rotation of drum (2) continues, the regulating means in the form of door (9) returns to the closed position.

Figure 6:
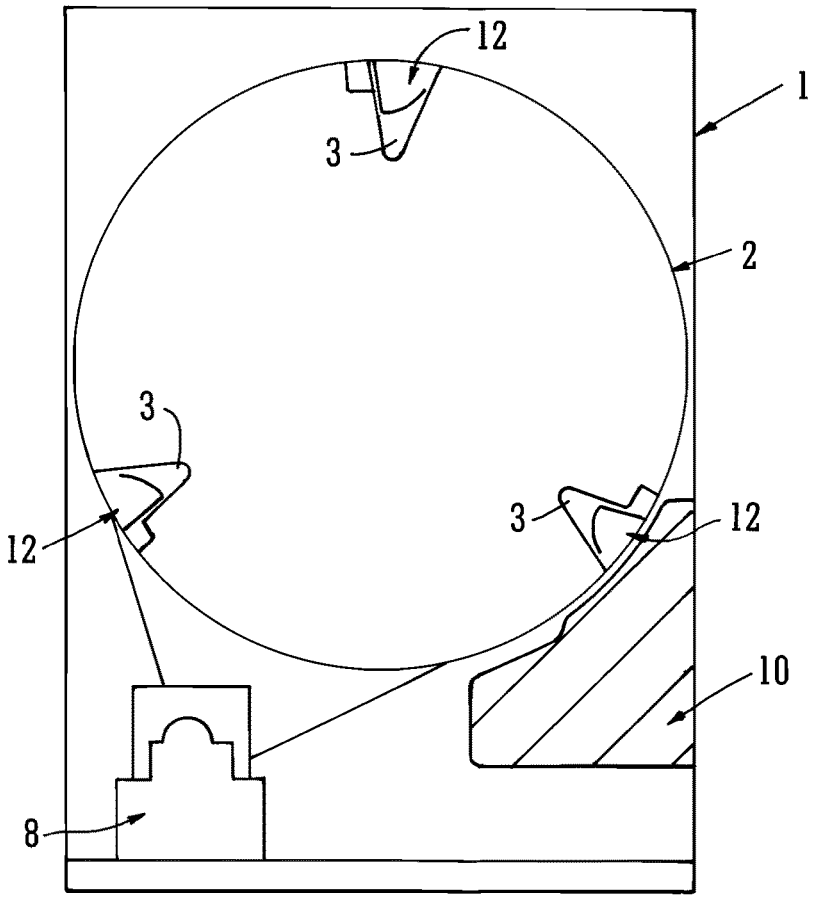
FIG. 6 illustrates an embodiment wherein the collection means is located adjacent a lower external surface of a rotatably mounted cylindrical drum in an apparatus according to the invention.

Considering FIG. 6, there is seen an apparatus according to the invention comprising housing means (1) having mounted therein a rotatably mounted cylindrical drum (2) and drive motor (8) located beneath said cylindrical drum. The apparatus additionally comprises capturing and transferring means comprising lifters (3) having regulating means in the form of doors (12) (c.f. doors (9) in FIGS. 4 and 5) in a second flow path through which solid particulate material is able to enter the collection means. The collection means comprises container (10) which is located below a lower circumferential face of the drum.

Figure 7:
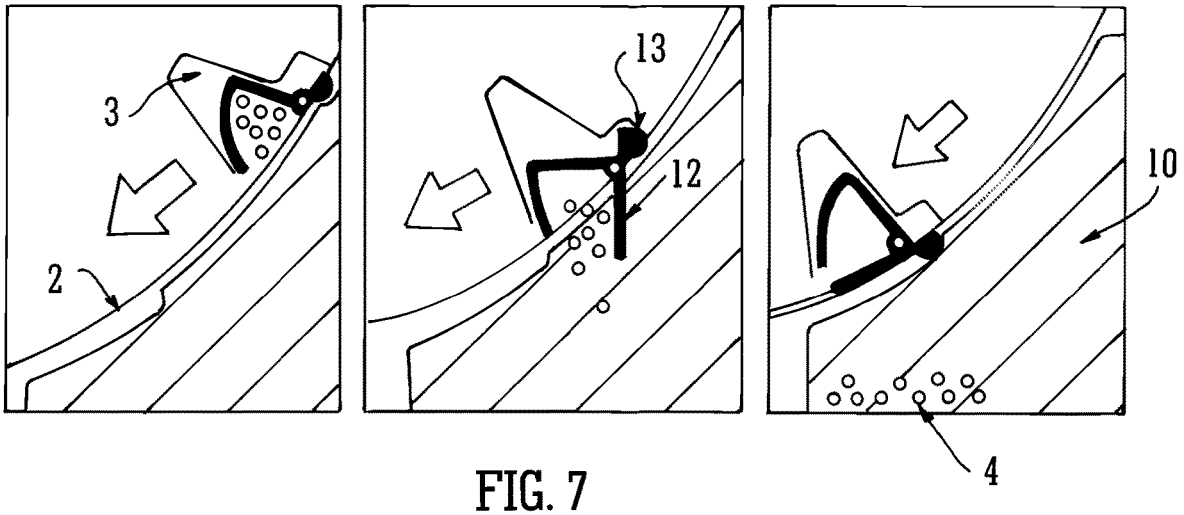
FIG. 7 shows the mode of operation of a further embodiment of capturing and transferring means comprised in the apparatus of the invention.

In FIG. 7, there is provided an illustration of an embodiment of the means for release of the solid particulate material from the capturing compartment of a lifter (3) into container (10) for an apparatus as shown in FIG. 6. Thus, in step 1, it is seen that the regulating means in the form of door (12) causes solid particulate material (4) to be held within the collecting compartment of lifter (3) until, in step 2, the door (12) is caused to open by the action of protrusion (13) (c.f. protrusion (11) in FIG. 5) against container (10) during rotation of the drum (2) thereby allowing the solid particulate material (4) to fall into container (10). Finally, in step 3, as rotation of the drum continues, the door (12) returns to the closed position.

Figure 8:
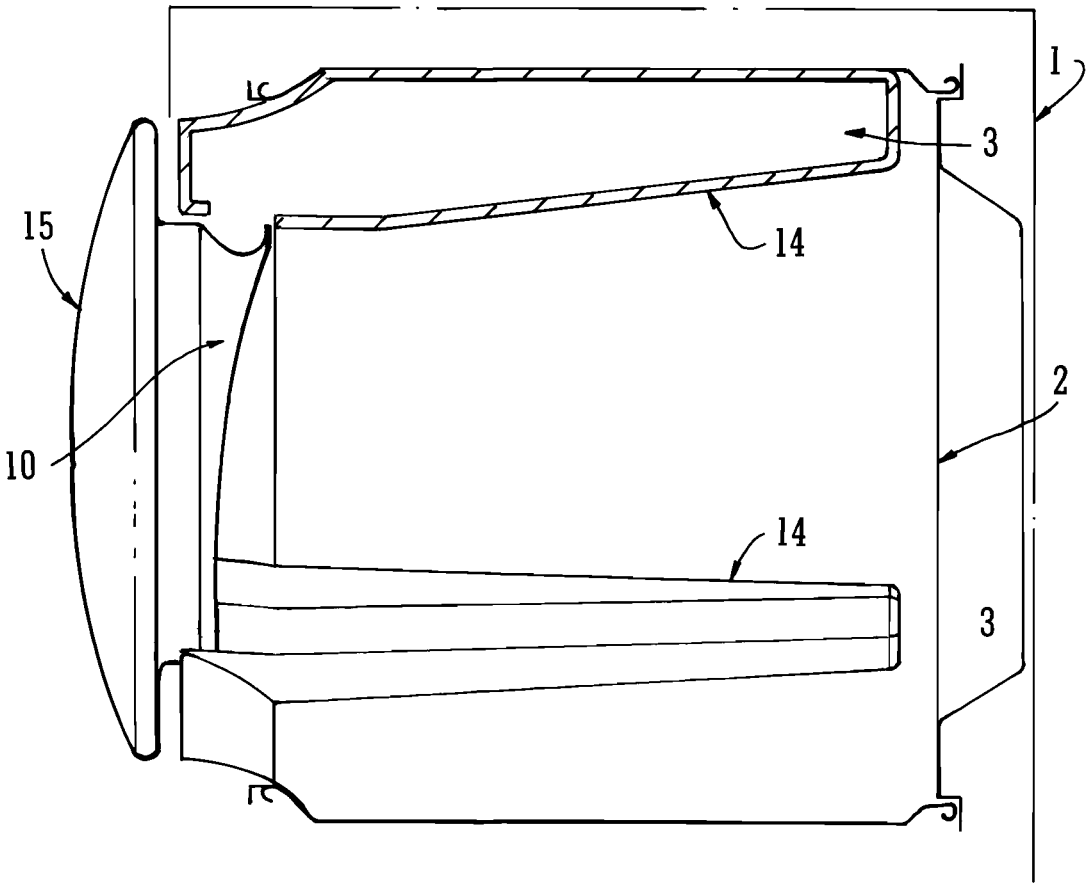
FIG. 8 illustrates an embodiment wherein the collection means is located in the access means at the front of a rotatably mounted cylindrical drum in an apparatus according to the invention.

Turning now to FIG. 8, there is shown an illustration of an apparatus according to the invention comprising a housing means (1) and a rotatably mounted cylindrical drum (2) including capturing and transferring means comprising lifters (3) wherein it can be seen that the lifters comprise sloping surfaces (14) which are inclined from rear to front of the rotatably mounted cylindrical drum, thereby causing solid particulate material to be directed to the front of the drum wherein the collection means comprises container (10) which is located in the access means in the form of door (15).

Figure 9:
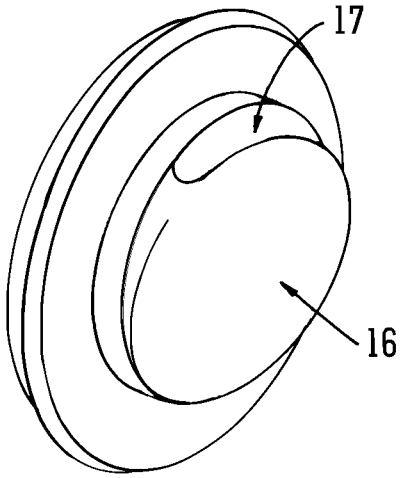
FIG. 9 illustrates a section of an access means which may be present in an apparatus according to an embodiment of the invention.

FIG. 9 illustrates a section of an access means comprising an inner surface (16) of a door which includes an orifice (17) which allows for passage of the solid particulate material to a container (not shown).

Figure 10:
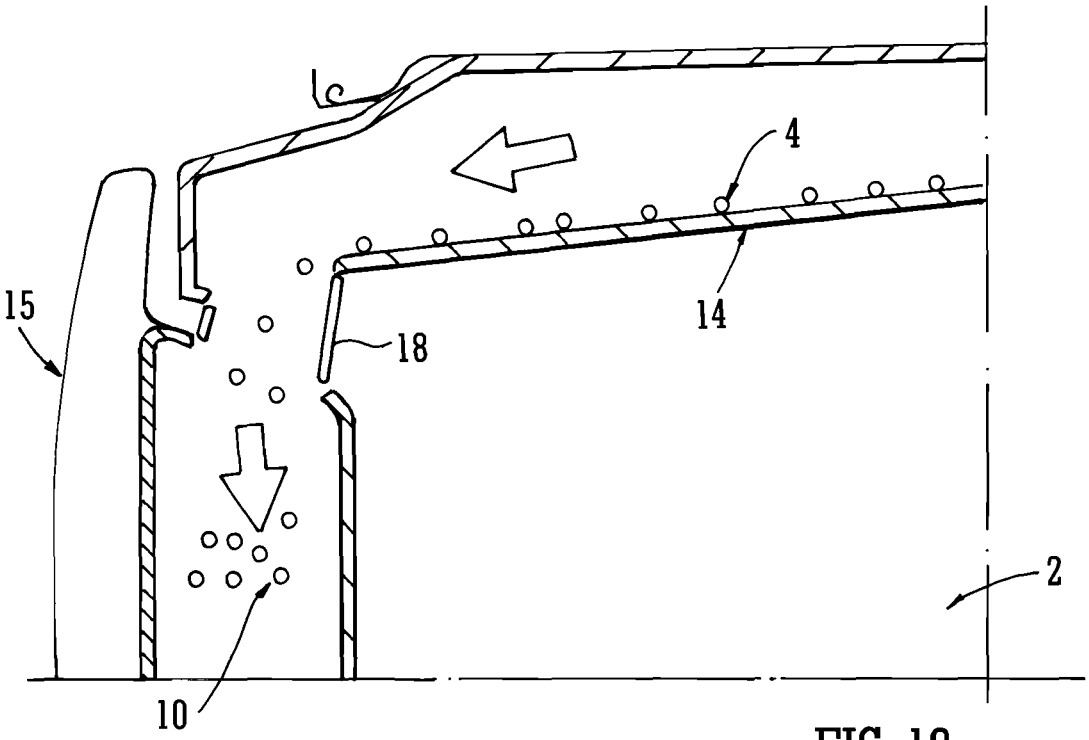
FIG. 10 shows the mode of operation of a further embodiment of capturing and transferring means comprised in an apparatus according to the invention.

In FIG. 10 there is seen a flow path for solid particulate material (4) in an embodiment of the invention such as is shown in FIG. 8, wherein the lifters comprise sloping surfaces (14) which are inclined from rear to front of a rotatably mounted cylindrical drum (2), thereby causing the solid particulate material to be directed to the front of the drum via member (18) to container (10) which is located in the door (15).

Figure 11:
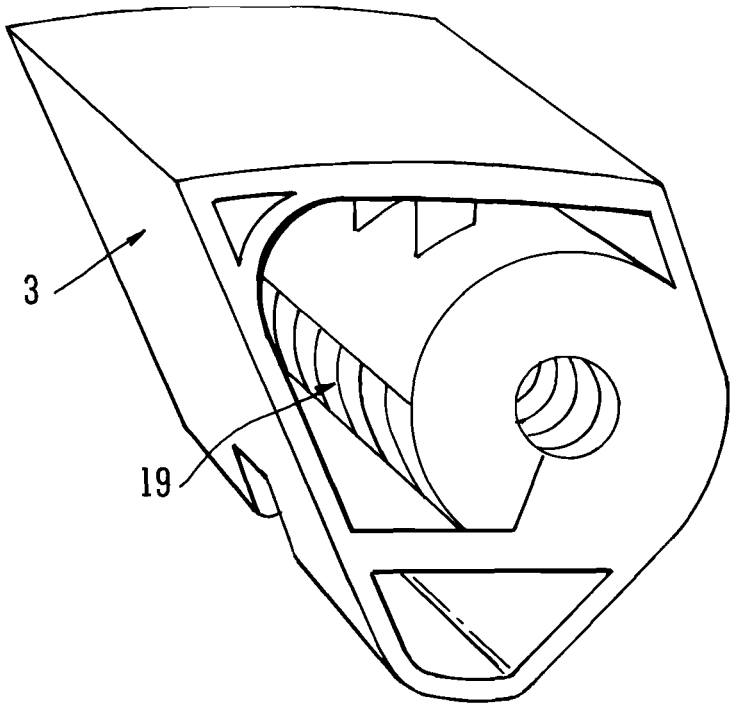
FIG. 11 shows an embodiment of routing means comprised in capturing and transferring means of an apparatus according to the invention.

FIG. 11 shows an embodiment of capturing and transferring means comprising an Archimedian screw (19) located in a lifter (3).

Figure 12:
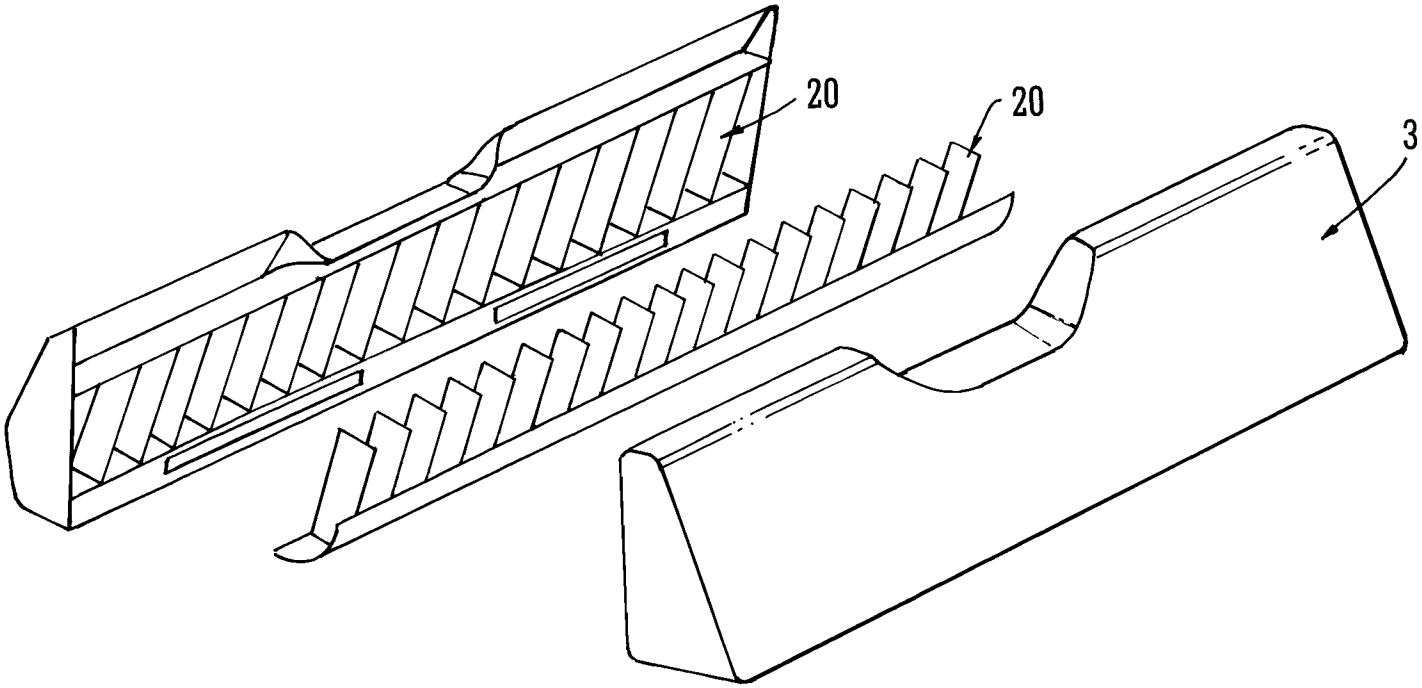
FIG. 12 shows a further embodiment of routing means comprised in capturing and transferring means of an apparatus according to the invention.

Referring now to FIG. 12 there is provided an exploded view of an embodiment of capturing and transferring means comprised in a lifter (3) which comprises a compartment which comprises a plurality of opposed offset chambers (20), arranged along each side of the inner walls of the lifters.

Figure 13:
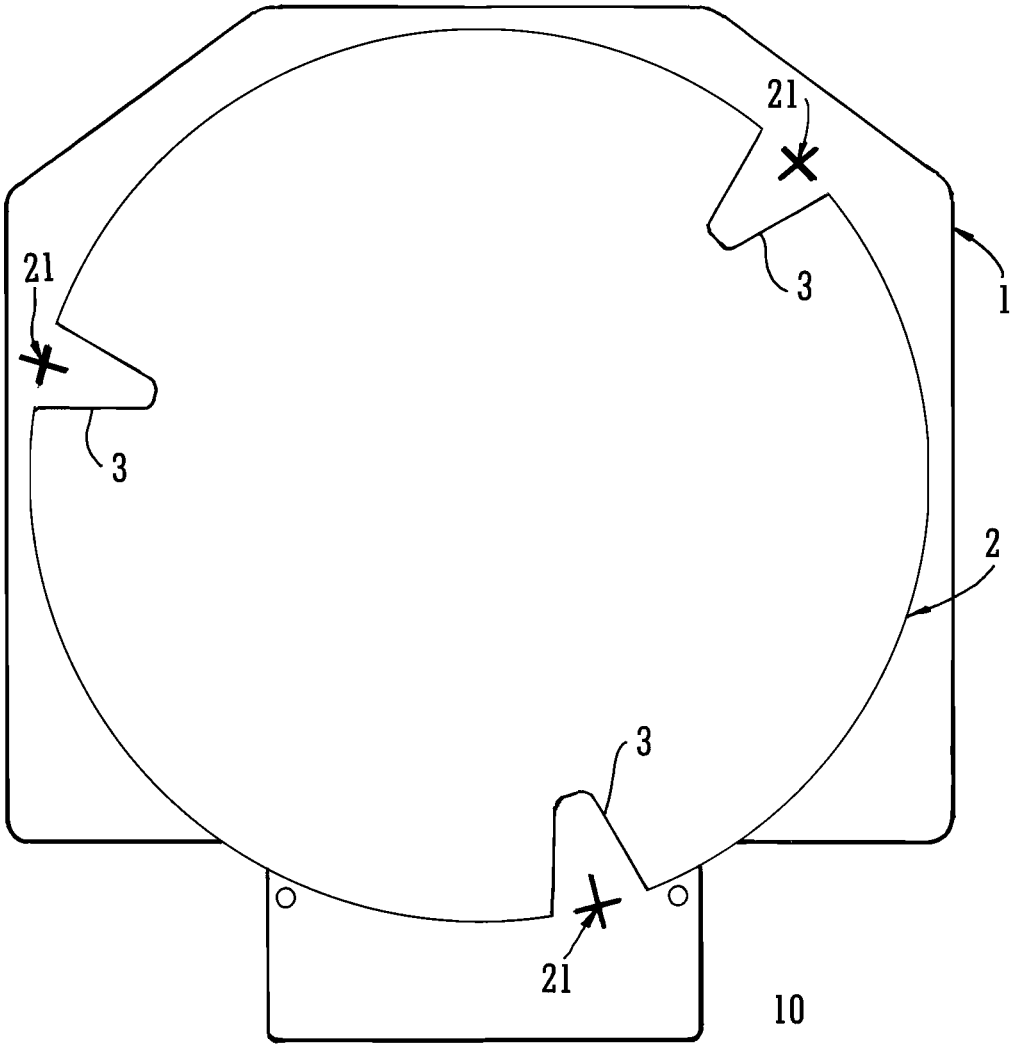
FIG. 13 illustrates a further embodiment wherein the collection means is located adjacent a lower external surface of a rotatably mounted cylindrical drum in the sump of an apparatus according to the invention.

Turning now to FIG. 13, there is illustrates an embodiment of the invention comprising housing means (1) in which is located a rotatably mounted cylindrical drum (2) having lifters (3) and collection means comprising container (10) situated adjacent a lower external surface of the drum (2) in the bottom of the apparatus. The apparatus comprises regulating means in the form of revolving doors (21) to control the flow of solid particulate material from lifters (3) to container (10).

Figure 14:
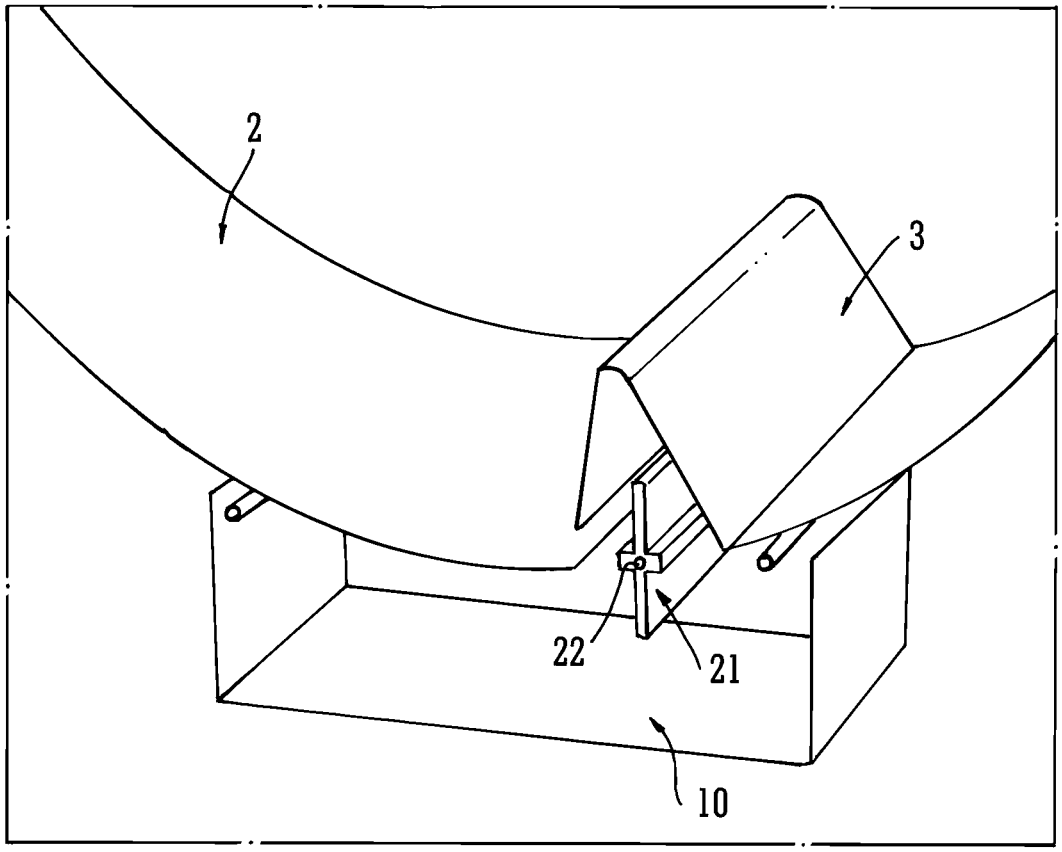
FIG. 14 shows an embodiment of regulating means comprised in the apparatus according to the invention which is illustrated in FIG. 13.

Referring to FIG. 14, there is seen a close-up view of the regulating means of FIG. 13 comprising revolving door (21) mounted on pin (22) at the base of lifter (3) to control the flow of solid particulate material from drum (2) to container (10).

Figure 15:
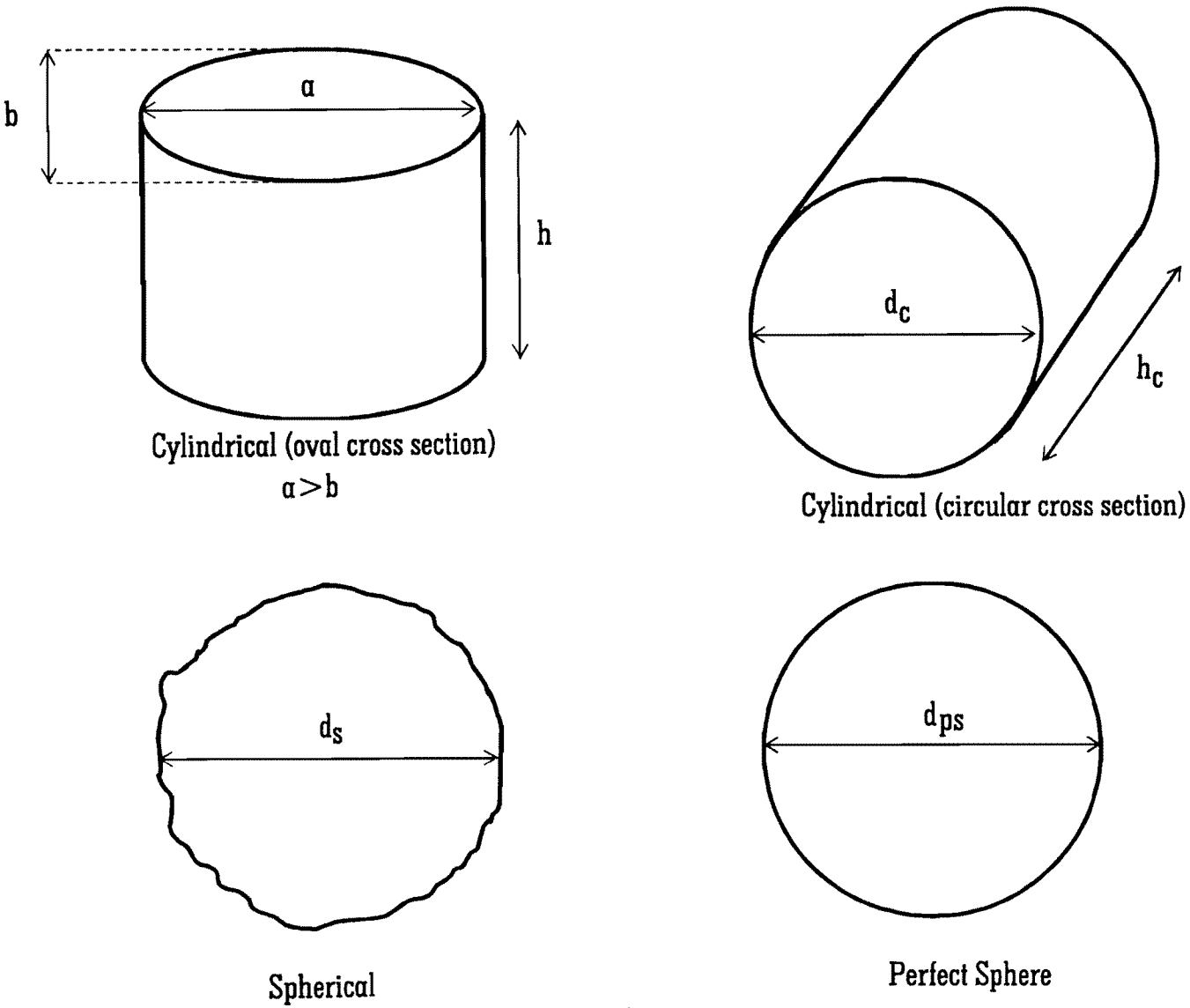
FIG. 15 is a diagrammatic representation of particles which are employed in the method of the invention.

Turning finally to FIG. 15, there is provided a diagrammatic representation of different cylindrical and spherical particles which may be utilised in the method of the invention.

The invention will now be further illustrated, though without in any way limiting the scope thereof, by reference to the following examples.

1. EXAMPLES

1.1 Comparative Examples

Bead separation experiments were conducted using a set of Comparative Examples (see Table 1). The Comparative Examples evaluated the number of beads remaining in the washload after a wash cycle in the preferred cleaning apparatus in the form of a washer as described in WO-A-2011/098815, hereinafter the Xeros US washer. Experiments were conducted using a 6 kg washload in accordance with British Standard EN 60456 as well as an internally defined 6 kg and 4 kg 'real world' load. The 'real world' load was made up of 50 wt % ballast in accordance with British Standard EN 60456 and 50% of trousers and shirts with pockets.

TABLE 1

| Test # | Washload (kg) | Pil-lowcases | Towels | Shirts | Trousers | Wash Cycle |
|---|---|---|---|---|---|---|
| 6 kg BS Ballast | 6 | 11 | 33 | 0 | 0 | Eco cold |
| 6 kg Real World Load | 6 | 5 | 20 | 7 | 4 | Eco cold |
| 4 kg Real World Load | 4 | 5 | 9 | 5 | 3 | Eco cold |

Experiments which evaluated the amount of beads remaining in the washload at the end of the wash cycle were run on the Xeros US washer using the Eco cold cycle (which uses approximately 31.5 of water at a temperature of 20° C.). At the end of the wash cycle the washload was removed, and the beads were separated from the garments and weighed. The results obtained from these Comparative Examples were as set out in Table 2.

TABLE 2

| Test # | Beads remaining in washload after wash cycle (g) | Wash Cycle time (min) |
|---|---|---|
| 6 kg BS Ballast | 0-1 g | 63 |
| 6 kg Real World Load | 10-30 g | 63 |
| 4 kg Real World Load | 0 g | 63 |

1.2 Examples

Examples which quantified the amount of beads remaining in the washload at the end of the washing and drying cycle were performed by the following steps:

(i) using the Xeros US washer; and then (ii) using the apparatus according to the present invention, hereinafter the Xeros US dryer which is a prototype apparatus.

Elaborating on these two steps further, step (i) was performed in exactly the same way as the Comparative Examples in section 1.1, the washload was run using an Eco cold cycle on the Xeros US washer. In step (ii) the washload was emptied into a wash basket, and transferred from the wash basket into the Xeros US dryer. The Xeros US dryer then ran a 2 hour drying cycle (the duration of this cycle is similar to the time taken by a conventional dryer to dry a 6 kg load). In this particular example the cycle in step (ii) was limited to tumbling of the washload in the drum, as the Xeros US dryer did not have the functionality to heat and blow air through the drum. At the end of this tumbling cycle the washload was removed, and any beads were separated from the garments and weighed. The results obtained from these Examples were as set out in Table 3.

TABLE 3

| Test # | Beads remaining in washload after drying cycle (g) | Drying Cycle time (min) |
|---|---|---|
| 6 kg BS Ballast | 0 | 120 |
| 6 kg Real World Load | 0 | 120 |
| 4 kg Real World Load | 0 | 120 |

2. RESULTS

As can be seen from Table 2, removal of the beads in the Xeros US washer was better when the washload was made up of flat garments, as used in the 6 kg British Standard ballast tests. When this Comparative Example was repeated with the Real World load, the removal performance was reduced, as beads tended to collect in the garment pockets and the arms/legs of the shirts/trousers. However, when the Real World load was reduced to 4 kg, and the effective free space in the drum was greater, all of the beads were removed after the wash cycle.

As can be seen from the Examples in Table 3, there were 0 g of beads left in the dryer after 2 hours for all types of washload. This showed that the Xeros US dryer (the apparatus according to the present invention) provided even further improvements in bead separation from the garments. Importantly, the dryer provided a means to remove the beads even from challenging "real world" wash loads at higher loading levels (6 kg).

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. An apparatus for use in the drying of substrates using a solid particulate material, said apparatus comprising:

(a) housing means having mounted therein a rotatably mounted cylindrical drum;

(b) access means; and (c) at least one collection means, wherein said rotatably mounted cylindrical drum additionally comprises capturing and transferring means, adapted to facilitate collection of said solid particulate material and transfer of said solid particulate material to said collection means, wherein said capturing and transferring means comprises routing means adapted to direct the transference of said solid particulate material to said collection means, and either wherein said capturing and transferring means is comprised in lifters and said routing means comprises a plurality of compartments each of which comprises a plurality of opposed offset chambers, arranged along each side of inner walls of the lifters, or wherein said routing means comprises an Archimedean screw.

2. An apparatus as claimed in claim 1 wherein said access means may be closed so as to provide a substantially sealed system.

3. An apparatus as claimed in claim 1 wherein said access means comprises a hinged door mounted in casing.

4. An apparatus as claimed in claim 1, wherein said rotatably mounted cylindrical drum comprises solid side walls including no perforations.

5. An apparatus as claimed in claim 1, wherein said rotatably mounted cylindrical drum comprises perforated side walls, wherein said perforations comprise holes having a diameter of no greater than 3.0 mm.

6. An apparatus as claimed in claim 1 wherein rotation of said rotatably mounted cylindrical drum is effected by use of drive means.

7. An apparatus as claimed in claim 1 wherein said capturing and transferring means comprises at least one receptacle comprising a first flow path facilitating ingress of the solid particulate material from said rotatably mounted cylindrical drum and a second flow path facilitating transfer of said solid particulate material to said collection means.

8. An apparatus as claimed in claim 7 wherein said second flow path comprises at least one orifice in a side wall of said rotatably mounted cylindrical drum, said at least one orifice having a diameter which allows said solid particulate material to transfer to said collection means.

9. An apparatus as claimed in claim 7 wherein said capturing and transferring means comprises regulating means, located in said second flow path and adapted to control the transfer of said solid particulate material to said collection means.

10. An apparatus as claimed in claim 9 wherein said regulating means comprises an openable door or flap.

11. An apparatus as claimed in claim 10 wherein said regulating means comprises a revolving door.

12. An apparatus as claimed in claim 10 wherein said regulating means comprises a repository wherein said solid particulate material may collect.

13. An apparatus as claimed in claim 9 wherein said regulating means is caused to open and close by actuating means comprising at least one of mechanical means, electrical means and magnetic means.

14. An apparatus as claimed in claim 1 wherein said capturing and transferring means is adapted such that ingress of the solid particulate material and transfer of said solid particulate material to said collection means is controlled by the direction of rotation of said rotatably mounted cylindrical drum.

15. An apparatus as claimed in claim 1 wherein said capturing and transferring means is comprised in spaced apart lifters affixed to the inner surface of said rotatably mounted cylindrical drum.

16. An apparatus according to claim 1 wherein said routing means comprises a plurality of compartments each of which comprises a plurality of opposed offset chambers, arranged along each side of the inner walls of the lifters such that, in operation, rotation of the rotatably mounted cylindrical drum causes the solid particulate material to be transferred from one side of the lifter to the other into a chamber which is partly offset from an opposite chamber, such that said solid particulate material is caused to be transported along the length of the lifter.

17. An apparatus according to claim 1 wherein said routing means comprises an Archimedean screw adapted so as to transport said solid particulate material along the length of the capturing and transferring means.

18. An apparatus as claimed in claim 1 wherein said routing means comprises an Archimedean screw, wherein said capturing and transferring means comprises an inner cylindrical drum skin located within, and concentric with, said rotatably mounted cylindrical drum, said inner cylindrical drum skin comprises perforations having a diameter no greater than 3.0 mm, and the outer surface of said inner cylindrical drum skin comprises routing means comprising an Archimedean spiral.

19. An apparatus as claimed in claim 1 wherein said collection means comprises a container.

20. An apparatus as claimed in claim 19 wherein said container is located adjacent an end surface of said rotatably mounted cylindrical drum.

21. An apparatus as claimed in claim 20 wherein said collection means is located adjacent a front end surface of said rotatably mounted cylindrical drum and is comprised in said access means.

22. An apparatus as claimed in claim 1 which comprises at least one recirculation means which facilitates recirculation of said solid particulate material from said collection means to said rotatably mounted cylindrical drum for re-use in drying operations.

23. A method for the drying of a wet substrate, said method comprising treating the wet substrate with a solid particulate material at ambient or elevated temperature, said treatment being carried out in an apparatus according to claim 1.

24. A method as claimed in claim 23 wherein said wet substrate comprises at least one textile fibre garment.

25. A method as claimed in claim 23 which comprises the steps of:

(a) introducing at least one wet substrate into said rotatably mounted cylindrical drum via access means;

(b) closing the access means so as to provide a substantially sealed system;

(c) introducing solid particulate material into said rotatably mounted cylindrical drum;

(d) operating the apparatus for a drying cycle, wherein said rotatably mounted cylindrical drum is caused to rotate and said solid particulate material is optionally recirculated through the apparatus until drying is completed;

(e) causing said rotatably mounted cylindrical drum to rotate so as to cause the solid particulate material to be captured by said capturing and transferring means and thereby transferred to said collection means; and (f) ceasing rotation of said rotatably mounted cylindrical drum.

26. A method as claimed in claim 25 which additionally comprises the steps of:

(g) removing said collection means from said apparatus; and (h) harvesting said solid particulate material for re-use in washing machines for cleaning operations which rely on the use of solid particulate material.

27. A method as claimed in claim 23 wherein said solid particulate material comprises a multiplicity of polymeric particles or a mixture of polymeric and non-polymeric particles.

28. A method as claimed in claim 27 wherein said polymeric particles comprise particles of polyamides, polyesters, polyalkenes or polyurethanes or their copolymers.

29. A method as claimed in claim 27 wherein said non-polymeric particles comprise particles of glass, silica, stone, wood, metals or ceramic materials.

30. A method as claimed in claims 23 wherein the ratio of solid particulate material to substrate is in the range of from 0.1:1 to 10:1 w/w.

* * * * *